US007551846B2

(12) United States Patent
Konishi et al.

(10) Patent No.: US 7,551,846 B2
(45) Date of Patent: Jun. 23, 2009

(54) INFRARED RAY LAMP, HEATING DEVICES AND ELECTRONIC DEVICE

(75) Inventors: Masanori Konishi, Kagawa (JP); Kenji Higashiyama, Ehime (JP)

(73) Assignee: Panasonic Corporation, Osaka (JP)

( * ) Notice: Subject to any disclaimer, the term of this patent is extended or adjusted under 35 U.S.C. 154(b) by 392 days.

(21) Appl. No.: 10/570,605

(22) PCT Filed: Aug. 13, 2004

(86) PCT No.: PCT/JP2004/011959

§ 371 (c)(1),
(2), (4) Date: Jul. 12, 2006

(87) PCT Pub. No.: WO2005/027581

PCT Pub. Date: Mar. 24, 2005

(65) Prior Publication Data

US 2006/0289418 A1 Dec. 28, 2006

(30) Foreign Application Priority Data

Sep. 10, 2003 (JP) ..... 2003-318305

(51) Int. Cl.
*F26B 3/30* (2006.01)

(52) U.S. Cl. ..... 392/411; 392/424

(58) Field of Classification Search ..... 392/411, 392/424

See application file for complete search history.

(56) References Cited

U.S. PATENT DOCUMENTS 4,125,761 A * 11/1978 Churchill ..... 219/544
7,267,597 B2 * 9/2007 Konishi et al. ..... 445/27
2002/0096984 A1 * 7/2002 Konishi et al. ..... 313/25
2004/0096202 A1 * 5/2004 Konishi ..... 392/407
2005/0100331 A1 * 5/2005 Konishi ..... 392/407
2005/0136785 A1 * 6/2005 Konishi et al. ..... 455/27
2007/0110413 A1 * 5/2007 Konishi ..... 392/407

FOREIGN PATENT DOCUMENTS

JP 61-202891 12/1986

(Continued)

OTHER PUBLICATIONS

English Language Abstract of JP 2001-351762.

(Continued)

*Primary Examiner*—Thor S Campbell
(74) *Attorney, Agent, or Firm*—Greenblum & Bernstein, P.L.C.

(57) ABSTRACT

The invention provides a heating apparatus which has a high heating efficiency, can locally heat a part to be heated, can achieve a rated temperature for an extremely short time after starting the heating, reduces a large rush current and flicker at a time of lighting, has a long service life, and can correspond to a plurality of modes having different heating widths, an infrared ray lamp suitable for the heating apparatus, and a high reliable electronic apparatus having the above-mentioned heating apparatus. The infrared ray lamp in accordance with the invention seals one or a plurality of heat generating elements in a glass tube, the heat generating elements having a shape extending in a longitudinal direction at a fixed width and an opening part extending substantially in a longitudinal direction provided only in a part in the longitudinal direction.

14 Claims, 17 Drawing Sheets

FOREIGN PATENT DOCUMENTS

| | | |
|---|---|---|
| JP | 4-112495 | 9/1992 |
| JP | 11-214126 | 8/1999 |
| JP | 11-307230 | 11/1999 |
| JP | 2001-351762 | 12/2001 |
| JP | 2002-110316 | 4/2002 |
| JP | 2003-215965 | 7/2003 |

OTHER PUBLICATIONS

English Language Abstract of JP 2003-215965.
English Language Abstract of JP 2002-110316.
English Language Abstract of JP 11-214126.
English Language Abstract of JP 11-307230.

* cited by examiner

HEAT GENERATING ELEMENT A HEAT GENERATING ELEMENT B

HEAT GENERATING ELEMENT A HEAT GENERATING ELEMENT B

HEAT GENERATING ELEMENT A HEAT GENERATING ELEMENT B

INFRARED RAY LAMP, HEATING DEVICES AND ELECTRONIC DEVICE

TECHNICAL FIELD

The present invention relates to an infrared ray lamp used as a heat source of an electronic apparatus such as a copying machine, a facsimile machine or a printer, a heating apparatus using the infrared ray lamp and the electronic apparatus.

BACKGROUND ART

In recent years, an infrared ray lamp which uses a carbon-based material formed in a rod shape as a heat generating element has been developed. The infrared ray lamp in accordance with a prior art is disclosed in Japanese Patent Publication No. 2001-351762 A. A description will be given of the infrared ray lamp in accordance with the prior art with reference to FIG. 17. FIG. 17 is an elevation showing a structure of the infrared ray lamp in accordance with the prior art. The infrared ray lamp has a transparent silica glass tube 1701 and a heat generating element 1702, and the heat generating element 1702 is sealed in the glass tube 1701.

The heat generating element 1702 is a carbon-based material formed into a long rod shape or plate shape, and is made of a mixed material obtained by adding a resistance value regulating material of a nitrogen combination and an amorphous carbon to a base material of a crystallized carbon such as a black lead or the like. By making the plate width of the heat generating element larger than the plate thickness, an amount of heat output from a surface having a plate width is more than an amount of heat output from a surface having a plate thickness whereby it is possible to apply directivity to a radiation of the heat generating element 1702.

The heat generating element has a first heat generating part 1702*a* and a second heat generating part 1702*b* corresponding to an oval region having a thinner plate thickness than the first heat generating part, and can set a temperature distribution in a longitudinal direction of the infrared ray lamp to a desired temperature distribution by changing the temperatures of the first heat generating part 1702*a* and the second heat generating part 1702*b* of the heat generating element.

Further, a cross sectional area of a section vertical to an axial direction (a longitudinal direction) is gradually changed along the longitudinal direction in a boundary part between the first heat generating part 1702*a* and the second heat generating part 1702*b* by making the second heat generating part 1702*b* oval, whereby a temperature change in the boundary part becomes slow.

Various precise electronic apparatuses (for example, the copying machine) have a heating apparatus in an inner part thereof. If the heating apparatus installed in the electronic apparatus mentioned above is always set in a heating state, an internal temperature of the electronic apparatus is increased more than necessary, or the heat is expanded to a wider region than a part which is necessary to be heated, so that there is a risk that a reduction of reliability and service life of the electronic apparatus is caused. Accordingly, it is important for securing the reliability and the service life of the electronic apparatus to heat the part which is necessary to be heated locally and only for a time which is required to be heated. Further, it is important that the heat generating element of the heating apparatus does not generate a great rush current.

For example, in the copying machine, it is necessary that the heating apparatus installed for drying a toner attached to a paper switches a width for heating the paper between a time of copying a wide A4 paper and a time of copying a longitudinal A4 paper. In the same manner, there are various electronic apparatuses (for example, a printer or the like) having a plurality of modes in which the heating widths are different. It is important for making the electronic apparatuses compact to make the heating apparatus compact.

The conventional electronic apparatus has a heating apparatus having a structure of inserting a heat generating element formed by winding a tungsten resistance wire spirally into a glass tube and generating heat in an ambient atmosphere. If the conventional heating apparatus is used in a state in which a temperature of a glass tube wall does not reach a predetermined temperature (typically equal to or more than 250° C.), a halogen cycle within the glass tube is not generated, and the tungsten is evaporated to become slim, so that there is a problem that the tungsten generates a disconnection so as to be shortened in a service life. Accordingly, in order to set the glass tube wall to the predetermined temperature, an ON-OFF control method is frequently employed in the electronic apparatus.

A temperature characteristic of the tungsten is a positive characteristic (in which a resistance is small in a normal temperature and the resistance becomes large if the temperature is increased). Accordingly, a large rush current flows first after applying a commercial alternating current power, and there is a risk that the other circuits in the electronic apparatus are damaged at a time of lighting. Since the tungsten heat generating element generates the large rush current every time of turning on and off, a device used in the same circuit is affected. Accordingly, a flicker phenomenon is caused.

Therefore, although a service life of the tungsten heat generating element is changed in accordance with a used temperature, it is only about 5000 hours.

Further, it is necessary to control for heating the part which is necessary to be heated by the tungsten heat generating element to a predetermined temperature, and a problem is generated. For example, at a standby time when the electronic apparatus is not used, it is necessary to warm up for improving a start. At this time, an extra electric power is required for setting the glass tube at a predetermined temperature.

The present invention purposes to provide a compact heating apparatus having a plurality of modes which are different in a heating width, and an infrared ray lamp suitable for the heating apparatus.

The present invention purposes to provide a high reliable electronic apparatus having the above-mentioned heating apparatus.

The present invention purposes to provide a heating apparatus which has a high heating efficiency, can locally heat a part to be heated, can achieve a rated temperature for an extremely short time after starting the heating, reduces a large rush current and flicker at a time of lighting, has a long service life, and can correspond to a plurality of modes having different heating widths, and an infrared ray lamp suitable for the heating apparatus.

DISCLOSURE OF INVENTION

In order to solve the above problem, the present invention has the following structures.

An infrared ray lamp in accordance with an aspect of the present invention includes one or a plurality of heat generating elements sealed in a glass tube, wherein the heat generating elements have a shape extending in a longitudinal direction at a fixed width and an opening part extending substantially in a longitudinal direction provided only in a part in the longitudinal direction of the heat generating element.

The heat generating element is structured such that a resistance per a unit length is large in the opening part, and the resistance per the unit length is small in the other parts. Accordingly, electric power consumption per a unit length becomes large and the heat generating element becomes high temperature in the opening part, and the electric power consumption per the unit length becomes small and the heat generating element becomes low temperature in the other parts. A heating apparatus having a plurality of heat generating elements in which the positions of the opening parts are different is suitable, for example, for an electronic apparatus having a plurality of modes having different heating widths. The present invention achieves a infrared lay lamps suitable for a heating apparatus which can be operated in a plurality of modes having different heating widths.

In the infrared ray lamp in accordance with another aspect of the present invention, the opening part is formed by disk burnishing (grinding). The heat generating element may get chipped in an edge part of the opening part or generate a powder dust. The chip or the dust reduces a commercial value of the heat generating element, and if it is serious, the heat generating element becomes a defective unit. A periphery of the opening part is formed to be a smooth slant face because of forming the opening part by the disk burnishing, the chip is hardly generated in the edge part, and the powder dust is hardly generated.

An infrared ray lamp in accordance with another aspect of the present invention has: a plurality of heat generating elements extending in a longitudinal direction and arranged in parallel; a glass tube sealing the heat generating elements; and a plurality of connecting terminals capable of independently conducting to the respective heat generating elements, wherein in at least two heat generating elements, a cross sectional area in a part in a longitudinal direction thereof is smaller than a cross sectional area in the other parts, and the heat generating elements are different from each other in positions of the small cross sectional areas.

It is possible to achieve a plurality of modes having different heating widths by using one infrared ray lamp of the present invention. By using the infrared ray lamp in accordance with the present invention, it is possible to achieve a more compact heating apparatus than the heating apparatus constituting of a plurality of infrared ray lamps.

The infrared ray lamp in accordance with another aspect of the present invention is provided, wherein in each of at least two heat generating elements, a cross sectional area in a part in a longitudinal direction of the heat generating element is substantially smaller than a cross sectional area in the other parts, and the heat generating elements are different from each other in positions of the small cross sectional areas, and are lapped over each other in positions of end parts in a longitudinal direction of the small cross sectional areas.

In accordance with the present invention, it is possible to achieve an infrared ray lamp which has an entire uniform calorific power per a unit length in the longitudinal direction by simultaneously applying an electric power to a plurality of heat generating elements which have the different calorific power per the unit length in accordance with the position in the longitudinal direction. In the heat generating element which has the different cross sectional area in accordance with the position in the longitudinal direction, the calorific power per the unit length is large in the part having the substantial small cross sectional area, and the calorific power per the unit length is small in the part having the substantial large cross sectional area. In the part having the small cross sectional area, the calorific power of the end part thereof (the part bordering on the part having the large cross sectional area) is smaller than the calorific power of the other parts than the end part. This is because a partial heat escapes from the part having the small cross sectional area to the part having the large cross sectional area. Accordingly, for example, in the case of simultaneously heating a first heat generating element which has the small cross sectional area in a predetermined part (called as "part A") in the longitudinal direction and the large cross sectional area in the other part (called as "part no-A"), and a second heat generating element which has the large cross sectional area in the part A and the small cross sectional area in the part no-A, a part having the calorific power per the unit length which is a little lower is generated in a boundary between the part A and the part no-A. In the case that the first heat generating element of the present invention is structured as mentioned above, the part having the small cross sectional area in the second heat generating element is set to a part including an end of the part A in addition to the part no-A. In other words, the first heat generating element and the second heat generating element are set such that the position of the end parts in the longitudinal direction of the part having the small cross sectional area are lapped over each other. Accordingly, in the case of simultaneously heating the first heat generating element and the second heat generating element, it is possible to make the calorific power per the unit length approximately uniform in all the parts in the longitudinal direction including the boundary between the part A and the part no-A.

The infrared ray lamp in accordance with another aspect of the present invention has: a plurality of cascaded elements arranged in parallel, the cascaded elements being made of a plurality of plate-shaped heat generating elements that extends in a longitudinal direction and are cascaded so as to be differentiated in an orientation of the heat generating element; a glass tube sealing the cascaded elements; and a plurality of connecting terminals capable of independently conducting to the respective cascaded elements, wherein in each of at least two cascaded elements, a radiation width is different based on a difference of the orientation of the heat generating element in accordance with a position in the longitudinal direction as seen from a predetermined direction, and the cascaded elements are different from each other in positions of the part having the large radiation widths.

For example, assuming that the cross sectional areas of the heat generating elements are fixed regardless of the position in the longitudinal direction, the calorific power which a subject to be heated placed at a fixed position with respect to the heat generating element receives is small in a part having a small width as seen from a direction of the subject to be heated, and is large in a part having a large width. The infrared ray lamp in accordance with the present invention arranges in parallel a plurality of cascaded elements that are formed by cascading the heat generating elements having a standard plate-shaped shape so as to be differentiated in the orientation. Accordingly, it is possible to achieve a plurality of modes having the different heating widths by using the simple infrared ray lamp in accordance with the present invention. It is possible to achieve a more compact heating apparatus than the heating apparatus including a plurality of infrared ray lamps, by using the infrared ray lamp in accordance with the present invention.

The infrared ray lamp in accordance with another aspect of the present invention is provided, wherein in each of at least two cascaded elements, a radiation width is substantially different based on the difference of orientation in the heat generating element in accordance with the position in the longitudinal direction, as seen from a predetermined direction, and the cascaded elements are different from each other in the position of the part having the substantial large radiation width, and are lapped over each other in the position of the end part in the longitudinal direction of the part having the substantial large radiation width. Accordingly, in the case of simultaneously heating a plurality of heat generating elements, it is possible to make the calorific power per the unit length approximately uniform, for example, in all the parts in the longitudinal direction.

In the infrared ray lamp in accordance with another aspect of the present invention, a cross sectional area of both end parts of the heat generating element or the cascaded element is substantially smaller than a cross sectional area in the parts other than the end parts, or a radiation width of both end parts is substantially larger than a radiation width in the other parts as seen from a predetermined direction. The heat generating element or the cascaded element is held by a holding member in both the end parts. In both the end parts, since a partial heat escapes to the holding member, the calorific power per the unit area becomes smaller than the other parts than both the end parts. In accordance with the structure of the present invention, the calorific power per the unit length of both the end parts of the heat generating element or the cascaded element can be larger than the other parts at such a degree as to compensate for the calorific power escaping to the holding member. Accordingly, the calorific power per the unit length can be approximately uniform in all the parts in the longitudinal direction including both the end parts.

The infrared ray lamp in accordance with another aspect of the present invention is provided, wherein in at least one heat generating element or the cascaded element, a calorific power per a unit area is approximately uniform in a longitudinal direction. It is possible to achieve a compact heating apparatus having a mode of applying an electric power to a heat generating element which has the large calorific power per the unit length in a predetermined part in the longitudinal direction so as to heat the part, and a mode of applying the electric power to the heat generating element which has the approximate uniform calorific power in the longitudinal direction so as to heat over an approximately entire length of the heating element, by using the infrared ray lamp in accordance with the present invention.

A heating apparatus in accordance with another aspect of the present invention includes the infrared ray lamp as recited in any one of the aspects mentioned above. In accordance with the present invention, it is possible to achieve a heating apparatus having a plurality of modes having different heating widths.

A heating apparatus in accordance with another aspect of the present invention has: a plurality of the above-mentioned infrared ray lamps arranged in parallel, wherein in at least two of infrared ray lamps, positions of the opening parts of the heat generating elements are different from each other. In accordance with the present invention, it is possible to achieve a heating apparatus having a plurality of modes having different heating widths. If attaching lengths of a plurality of infrared ray lamps are identical, it is possible to achieve a heating apparatus having a plurality of modes having the different heating widths based on the simple attaching structure.

The heating apparatus in accordance with another aspect of the present invention arranges a plurality of infrared ray lamps in parallel, the infrared ray lamps sealing one or a plurality of heat generating elements extending in a longitudinal direction in a glass tube, wherein in the heat generating elements of each of at least two infrared ray lamps, a cross sectional area in a part in the longitudinal direction of the heat generating element is substantially smaller than a cross sectional area in the other parts the heat generating elements of the infrared ray lamps are different from each other in the position of the small cross sectional area, and the positions of one ends in the longitudinal direction of the small cross sectional area are lapped over each other. In accordance with the present invention, it is possible to achieve a heating apparatus having a plurality of modes in which the heating widths are substantially different, and, for example, in which the calorific power per the unit length in all the parts in the longitudinal direction is approximately uniform, in the case of simultaneously heating a plurality of infrared ray lamps.

A heating apparatus in accordance with another aspect of the present invention arranges a plurality of infrared ray lamps in parallel, the infrared ray lamps sealing one or a plurality of heat generating elements extending in a longitudinal direction in a glass tube, wherein in the heat generating elements of each of at least two infrared ray lamps, a radiation width of the heat generating element in a part in the longitudinal direction of the heat generating element is substantially larger than a radiation width in the other parts as seen from a predetermined direction, the heat generating elements of the infrared ray lamps are different from each other in the position of the part having the substantial large radiation width, and the positions of one ends in the longitudinal direction of the part having the substantial large radiation width are lapped over each other. In accordance with the present invention, it is possible to achieve a heating apparatus having a plurality of modes in which the heating widths are substantially different, and in which, for example, the subject to be heated is uniformly heated in all the parts in the longitudinal direction, in the case of simultaneously heating a plurality of infrared ray lamps.

In accordance with another aspect of the present invention, a heating apparatus has: a plurality of infrared ray lamps arranged in parallel, the infrared ray lamps respectively having one or a plurality of heat generating elements that extends in a longitudinal direction and are sealed in a glass tube; and a reflection film that extends substantially in a longitudinal direction and is provided in an outer periphery of the glass tube; wherein in at least two infrared ray lamps, positions in the longitudinal direction of the reflection films or positions of parts having the largest widths are different from each other. In accordance with the present invention, it is possible to achieve a heating apparatus having a plurality of modes in which the heating widths are substantially different.

A heating apparatus in accordance with another aspect of the present invention has: a plurality of infrared ray lamps arranged in parallel, the infrared ray lamps sealing one or a plurality of heat generating elements extending in a longitudinal direction in a glass tube; and one or a plurality of reflection plates extending in a longitudinal direction, provided so as to be closely contacted to the glass tube or keep at a predetermined distance and having a plurality of reflection regions mainly reflecting an emitted light of the infrared ray lamps; wherein in at least two reflection regions, positions in the longitudinal direction of the reflection regions or positions of parts having the largest width thereof are different from each other. In accordance with the present invention, it is possible to achieve a heating apparatus having a plurality of modes in which the heating widths are substantially different.

The heating apparatus in accordance with another aspect of the present invention, in at least two infrared ray lamps, positions in a longitudinal direction of the reflection films or the reflection regions or positions of the largest width of the reflection films or the reflection regions are different from each other, and positions of one ends in the longitudinal direction of the reflection films or the reflection regions or positions of one ends of the largest width of the reflection films or the reflection regions are lapped over each other. In accordance with the present invention, it is possible to achieve a heating apparatus having a plurality of modes in which the heating widths are substantially different, and in which a calorific power per a unit length is approximately uniform, for example, in all the parts in the longitudinal direction, in the case of simultaneously heating a plurality of infrared ray lamps.

The heating apparatus in accordance with another aspect of the present invention has at least one infrared ray lamp which has an effective calorific power per a unit area which is approximately uniform in a longitudinal direction. In accordance with the present invention, it is possible to achieve a heating apparatus having a mode of heating a predetermined part in the longitudinal direction, and a mode of heating an approximately entire length of the heating element.

The heating apparatus in accordance with another aspect of the present invention has: a first heat generating element and a second heat generating element which are different in an effective calorific power per a unit area in accordance with a position in a longitudinal direction, wherein only the first heat generating element generates heat in a first mode, both of the first heat generating element and the second heat generating element generate heat in a second mode, and an effective calorific power per a unit area becomes approximately uniform in a longitudinal direction in the second mode. In accordance with the present invention, it is possible to achieve a heating apparatus having the first mode of heating the predetermined part in the longitudinal direction, and the second mode of heating an entire length of the heating element.

In the heating apparatus in accordance with another aspect of the present invention, an applied power to the first heat generating element in the second mode is smaller than an applied power to the first heat generating element in the first mode.

For example, in the case that the heating apparatus is structured by two heat generating elements (the first heat generating element and the second heat generating element) described above, the first heat generating element generates heat at Q1 calorie per a unit length in the opening part, in the first mode. If the same power as that of the first mode is applied to the first heat generating element in the second mode, the first heat generating element generates heat at Q1 calorie per a unit length in the opening part. However, in the second mode, the other parts than the opening part of the second heat generating element generate heat in some degree (it is assumed that the calorific power per the unit length is set to Q2 calorie (Q1>Q2)). Accordingly, a total of the calorific power per the unit length in the second mode is expressed by (Q1+Q2) calorie, and becomes higher than that in the first mode. In many cases, it is preferable to set the calorific power per the unit length to be identical between the first mode and the second mode. In accordance with the present invention, it is possible to achieve a heating apparatus in which the calorific power per the unit length is identical between the first mode and the second mode.

The heating apparatus in accordance with another aspect of the present invention controls an applied power to the first heat generating element by a phase control based on an alternating input voltage in the first mode and the second mode. In accordance with the present invention, it is possible to control the calorific power of each of the heat generating elements at a high precision based on the phase control. In accordance with the present invention, it is possible to achieve a heating apparatus in which, for example, the calorific powers per the unit length are identical between the first mode and the second mode.

The heating apparatus in accordance with another aspect of the present invention has: a temperature sensor detecting a temperature of a predetermined place, wherein the heating apparatus controls an applied power to the first heat generating element and the second heat generating element by a phase control based on an alternating input voltage in accordance with the detected temperature. The heating apparatus in accordance with the present invention can control the temperature of the predetermined place to a target value at a high precision by the phase control.

In the heating apparatus in accordance with another aspect of the present invention, the heat generating element is a carbon-based heat generating element formed by a sintered body including a carbon-based material. In accordance with the present invention, it is possible to achieve a heating apparatus which has a high heating efficiency, can locally heat a part to be heated, reaches a rated temperature for an extremely short time after starting the heating, reduces a large rush current and flicker at a time of lightening, has a long service life, and can correspond to a plurality of modes having the different heating widths.

An electronic apparatus in accordance with another aspect of the present invention has any one of the above-mentioned heating apparatus which heats the heat generating element or the cascaded element based on different combinations in accordance with a length or a position of a subject to be heated in a longitudinal direction of the heat generating element or the cascaded element.

In accordance with the present invention, it is possible to achieve a high reliable electronic apparatus having a plurality of modes in which the widths heated by the heating apparatus are different. Further, it is possible to make the electronic apparatus compact at a degree at which the heating apparatus can be made compact.

The electronic apparatus in accordance with another aspect of the present invention is a copying machine, a facsimile machine, a printer, a printing machine, a fixing apparatus, an adhesion apparatus using a thermosetting adhesive agent, a ticket machine, an automatic ticket checking machine, a paper container manufacturing apparatus or a film heat fusion machine. In accordance with the present invention, it is possible to achieve a high reliable electronic apparatus having a plurality of modes in which the widths heated by the heating apparatus are different.

In the case that the sintered body including the carbon-based material is used as the heat generating element, a time until reaching a rated temperature after starting the heating is extremely short and a service life is long because the heat generating element has a high heating efficiency and a small calorific capacity. The heat generating element formed by the sintered body including the carbon-based material can locally heat a part which is required to be heated for a time which is required to be heated. Further, at a standby time when the electronic apparatus is not used, it is necessary to warm up for improving a start, however, it is not necessary to set the glass tube to a predetermined temperature even at this time, and a minimum electric power is sufficient. Accordingly, it is possible to secure reliability and a service life of the electronic apparatus, and it is possible to reduce electric power consumption. Further, since a resistance change is small based on the temperature of the heat generating element, the rush current is not generated, the flicker phenomenon is reduced, and the other circuits of the electronic apparatus are not damaged even at a time of lighting.

In the electronic apparatus in accordance with another aspect of the present invention, the heating apparatus has a color mode of fixing a color paint and a black-and-white mode of fixing a black-and-white paint, and an electric power applied to the heat generating element in the color mode is larger than an electric power applied to the same heat generating element in the black-and-white mode. In accordance with the present invention, it is possible to achieve a high reliable electronic apparatus having a plurality of modes in which the widths heated by the heating apparatus are different, having the different applied power to the heat generating element between the color mode and the black-and-white mode. A method of switching the electric power applied to the heat generating element between the color mode and the black-and-white mode is optionally selected, for example, in accordance with a phase control based on an alternating input voltage.

While the novel features of the invention are set forth particularly in the appended claims, the invention, both as to organization and content, will be better understood and appreciated, along with other objects and features thereof, from the following detailed description taken in conjunction with drawings.

It will be recognized that some or all of the figures are schematic representations for purpose of illustration and do not necessarily depict the actual relative sizes or locations of the elements shown.

BEST MODE FOR CARRYING OUT THE INVENTION

A description will be given below of embodiments particularly showing a best mode for carrying out the present invention, with reference to the accompanying drawings.

Embodiment 1

Figure 1A:
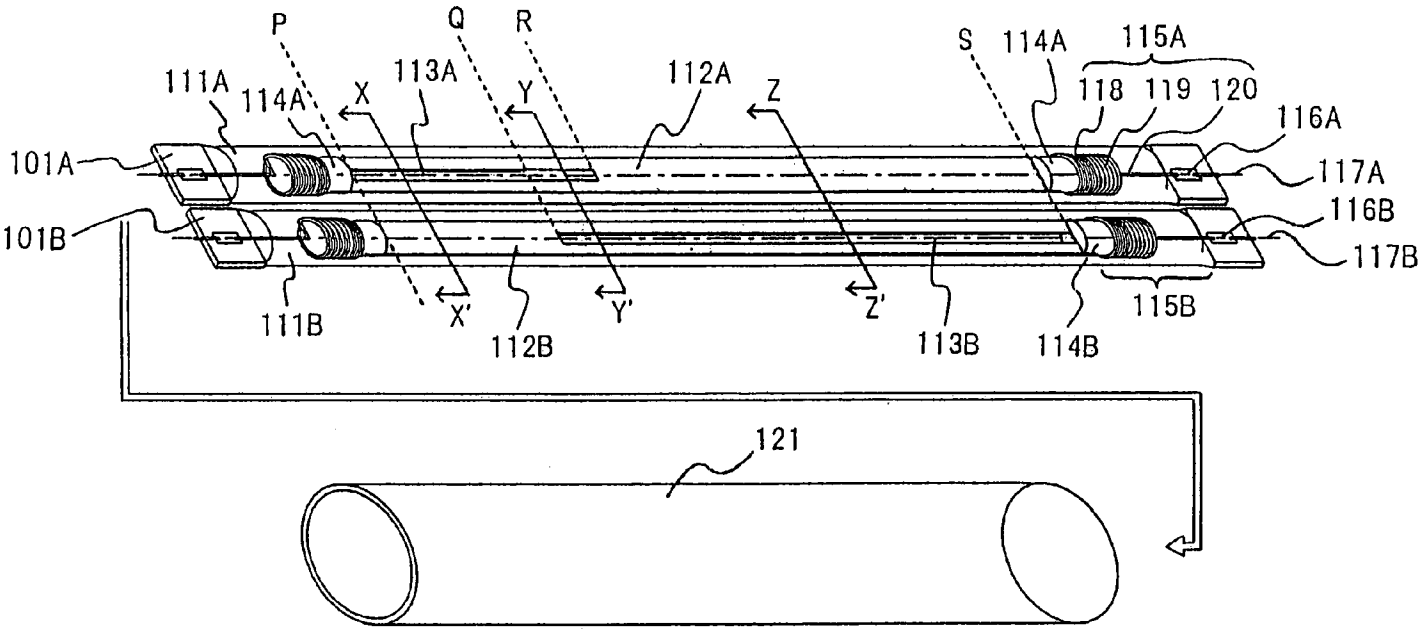
FIGS. 1A-B are views showing a structure of an infrared ray lamp in accordance with an embodiment 1 of the present invention.
Figure 1B:
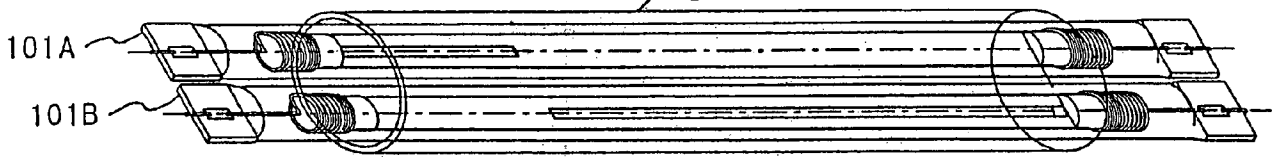

A description will be given of an infrared ray lamp, a heating apparatus and an electronic apparatus in accordance with an embodiment 1 with reference to FIGS. 1 to 7. FIG. 1 is a view showing a structure of the infrared ray lamp in accordance with the embodiment 1 of the present invention. FIG. 1B is a view showing a state in which two infrared ray lamps shown in FIG. 1A are inserted to a heating roller of a copying machine.

An infrared ray lamp 101A is formed by sealing a long plate-shaped heat generating element 112A, a holding block 114A and an internal lead wire 115A in a glass tube 11A. In the same manner, the infrared ray lamp 101B is formed by sealing a long plate-shaped heat generating element 112B, a holding block 114B and an internal lead wire 115B in a glass tube 111B. The glass tube 111 is a transparent silica glass tube and an inert gas such as an argon gas or like is sealed in the glass tube. An end part of the glass tube 111 is fused and crushed in a flat plate shape so as to seal.

In each of the infrared ray lamps 101A and 101B, the internal lead wire 115 is connected to an external lead wire 117 via a molybdenum foil 116. When applying an electric power to the external lead wire 117 derived from both sides, an electric current flows through a heat generating element 112A and/or 112B, and a heat is generated due to a resistance of the heat generating element. At this time, an infrared ray is radiated from the heat generating element 112A and/or 112B.

The heat generating elements 112A and 112B are constituted by a carbon-based material formed in a long rod shape or plate shape, and is made a mixed material obtained by adding a resistance value regulating material of a nitrogen compound and an amorphous carbon to a base material of a crystallized carbon such as a black lead or the like. A dimension of the heat generating elements 112A and 112B is constituted, for example, such that a plate width W is 6 mm, a plate thickness T is 0.5 mm, and a length is 300 mm. It is desirable that a ratio between the plate thickness and the plate width in the heat generating elements 112A and 112B is equal to or more than 1:5. A heat output from a surface having the plate width W becomes more than a heat output from a surface having the plate thickness T by making the plate width W larger than the plate thickness T, whereby it is possible to apply a directivity to a radiation of the heat generating elements 112A and 112B.

A heat generating efficiency of the heat generating element of the carbon-based material is high, a time until reaching a rated temperature after starting the heating is extremely short, and a rush current and a flicker at a time of lighting are not generated. A service life thereof is about 10000 hours (it is about twice as much as a service life of a tungsten heat generating element under a certain used temperature).

Figure 7:
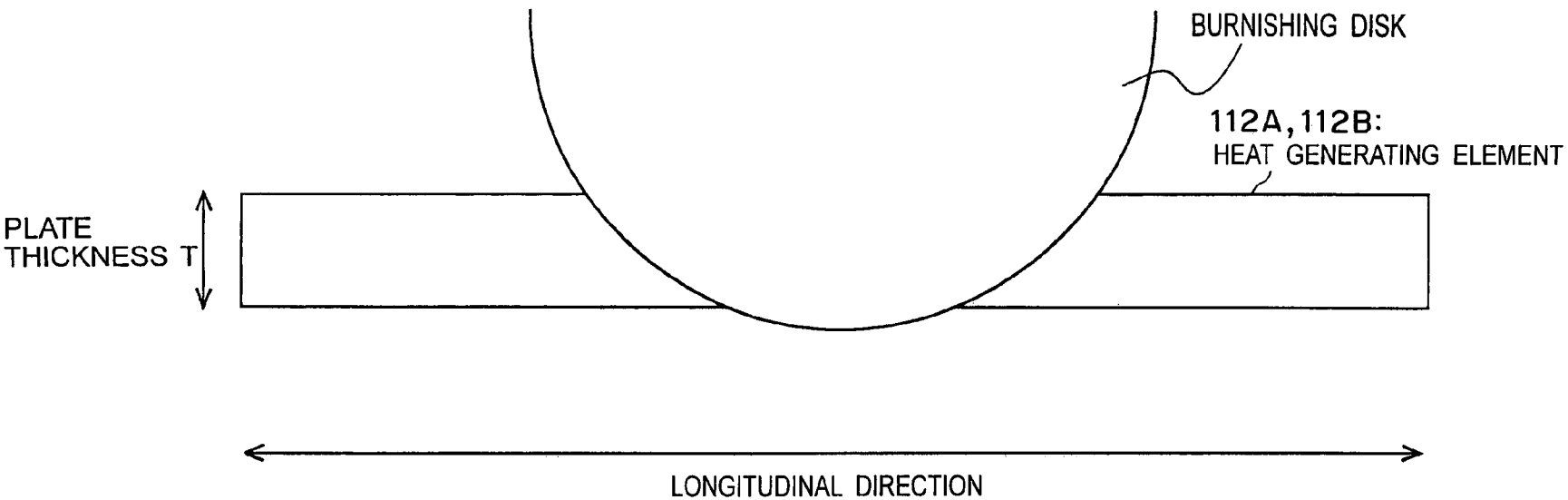
FIG. 7 is a view showing a manufacturing method of an opening part of the heat generating element in accordance with the embodiment 1 of the present invention.

The heat generating elements 112A and 112B have respectively opening parts 113A and 113B having different positions in a longitudinal direction. FIG. 7 is a view showing a method of burnishing (grinding) the heat generating elements 112A and 112B by disk. In FIG. 7, a center of rotation of the burnishing disk (grinding disk) exists in a direction perpendicular to the longitudinal direction of the heat generating element. A diameter of the burnishing disk (grinding disk) is longer than a length of the opening parts 113A and 113B of the heat generating elements 112A and 112B. A width of the burnishing disk (grinding disk) is equal to a width of the opening parts 113A and 113B of the heat generating elements 112A and 112B. The opening parts 113A and 113B are formed by burnishing (grinding) a surface with respect to the longitudinal direction of the heat generating elements 112A and 112B by disk as shown in FIG. 7. An outer peripheral part of a start point and an end point of the opening part of the heat generating element is formed so as to be inclined with respect to a thickness direction by the disk burnishing (grinding). Accordingly, it is possible to reduce a stress at the start point of the opening part to obtain a structure which is strong against a vibration and an impact.

A cross sectional shape in a width direction (a direction perpendicular to a paper surface in FIG. 7) of the burnishing disk (grinding disk) is provided with a predetermined roundness. Accordingly, a predetermined slant face is formed in a side surface in the width direction of the opening part. It is possible to reduce the stress in the side surface of the opening part, and to obtain the structure which is strong against the vibration and the impact.

Figure 2A:
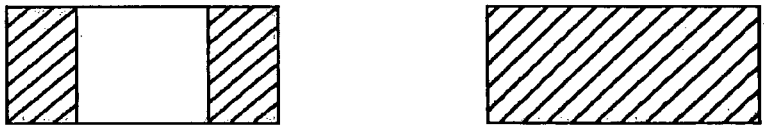
FIGS. 2A-C are a cross sectional views of a heat generating elements in accordance with the embodiment 1 of the present invention.
Figure 2B:
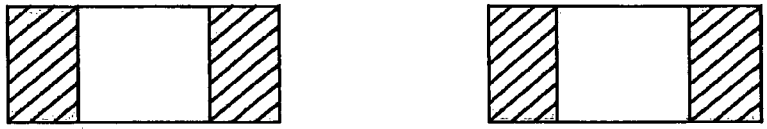
Figure 2C:
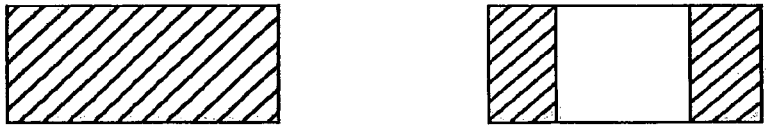

FIG. 2 is a cross sectional view along lines X-X', Y-Y' and Z-Z' of the heat generating elements 112A and 112B in FIG. 1. As shown in FIG. 2B, an end part in the longitudinal direction of the opening part 113A and an end part in the longitudinal direction of the opening part 113B are formed so as to be overlapped. An end surface of the opening part 113 is chamfered.

Figure 3A:
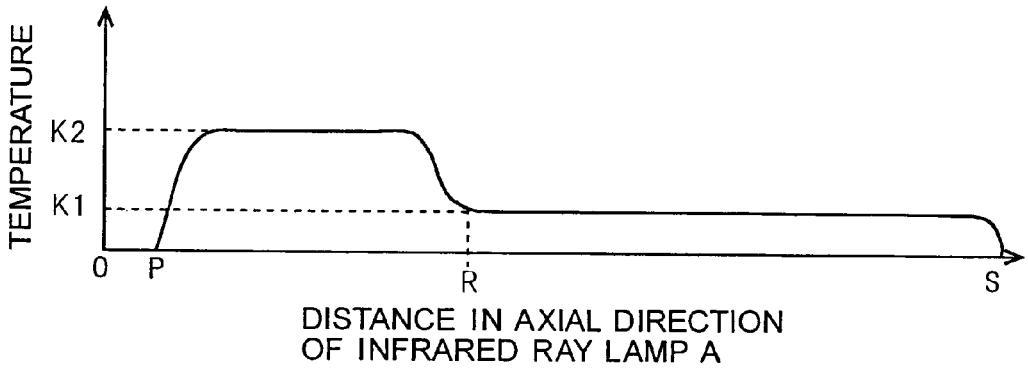
FIGS. 3A-C are temperature distribution views of the infrared ray lamp in accordance with the embodiment 1 of the present invention.
Figure 3B:
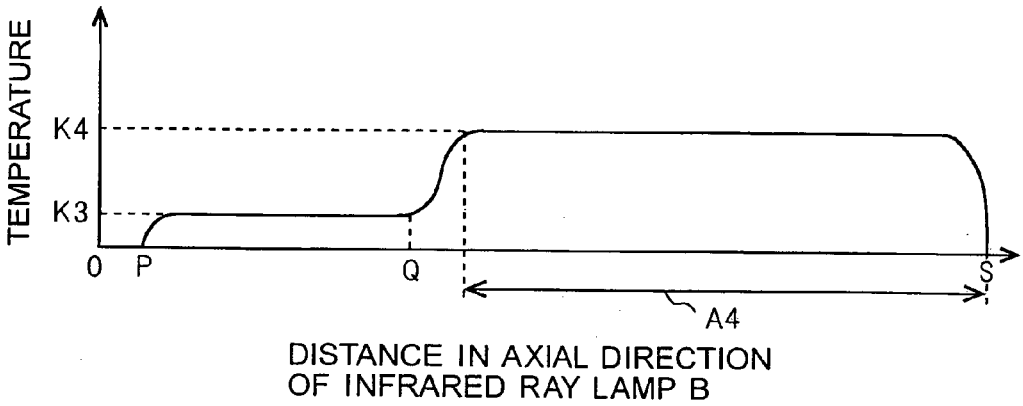
Figure 3C:
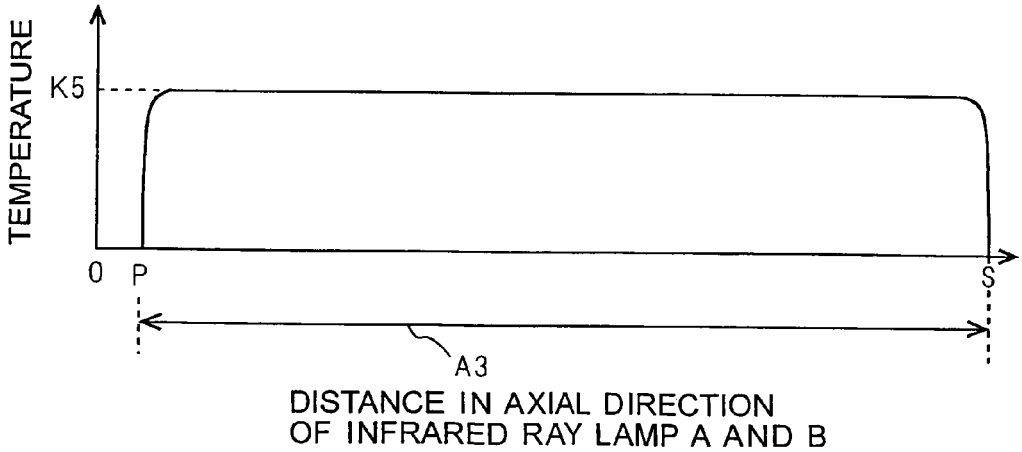

FIG. 3A is a temperature distribution view with respect to an axial direction (a longitudinal direction) in the case that only the heat generating element 112A generates heat, FIG. 3B is a temperature distribution view with respect to the axial direction in the case that only the heat generating element 112B generates heat, and FIG. 3C is a temperature distribution view with respect to the axial direction in the case that the heat generating element 112A and the heat generating element 112B generate heat. The temperature can be measured by a small area radiation thermometer or by measuring a radiant heat by means of a thermopile. A horizontal axis in FIG. 3 shows a distance in an axial direction of the infrared ray lamp, and an origin 0 corresponds to a boundary part between the holding block 114 and a coil part 118 in a left side in FIG. 1. A vertical axis in FIG. 3 shows a temperature.

In accordance with FIG. 3A, a temperature K2 between points P and R having the opening part 113A of the heat generating element 112A is higher than a temperature K1 between points R and S having no opening part. A cross sectional area of the heat generating element between the points P and R having the opening part 113A is smaller than that between the points R and S, and a resistance per a unit length between the points P and R of the heat generating element 112A is larger than that between the points R and S having no opening part 113A. Accordingly, a Joule heat per a unit length between the points P and R generated by an electric current flowing through the heat generating element 112A is more than a Joule heat between the points R and S, and a temperature between the points P and R becomes higher than a temperature between the points R and S. The same matter is applied to FIG. 3B, and a temperature K4 between points Q and S having the opening part 113B becomes higher than a temperature K3 between points P and Q having no opening part 113B. In the embodiment 1, a temperature K4 is equal to a temperature K2 and a temperature K3 is equal to a temperature K1.

The infrared ray lamp 101 in accordance with the embodiment 1 is used in an electronic apparatus (it is a copying machine in the embodiment 1). Since two heat generating elements having the opening parts which have respectively different positions from each other in the longitudinal direction are provided, it is possible to change a heating part in accordance with a size of a paper. For example, in the case of copying a landscape paper of A4 size, an electric power is supplied only to the heat generating element B (a first mode, FIG. 3B). Accordingly, it is possible to prevent the electric power from being wastefully consumed. In the case of copying and printing a landscape paper of A3 size (or a portrait paper of A4 size), the electric power is supplied to both of the heat generating elements A and B (a second mode, FIG. 3C). In the second mode, an effective calorific power per a unit area is approximately uniform in the longitudinal direction. In the embodiment 1, a temperature K5 of the heat generating element in the second mode is equal to the temperature K2 by a control mentioned below (FIG. 4).

The cylinder-shaped holding block 114 is formed by a conductive material, and is attached so as to be electrically connected to both ends of the heat generating elements 112A and 112B. The internal lead wire 115 includes a coil part 118, a spring part 119 and a lead wire 120. It is preferable that the holding block 114 is formed from a material (for example, a black lead) which is hard to transmit the heat of the heat generating elements 112A and 112B to the coil part 118 of the internal lead wire 115. The holding block 114 is inserted to the coil part 118 which is obtained by forming a metal wire having an elasticity such a molybdenum, a tungsten or the like into a spiral shape. The coil part 118 is wound around an outer peripheral surface of the holding block 114 so as to be closely attached, and both the elements are electrically connected. The coil part 118 is joined to the lead wire 120 via the spring part 119 having an elasticity. Since the spring part 119 is provided between the lead wire 120 and the coil part 118, it is possible to absorb a dimensional change due to an expansion of the heat generating elements 112A and 112B.

Figure 4:
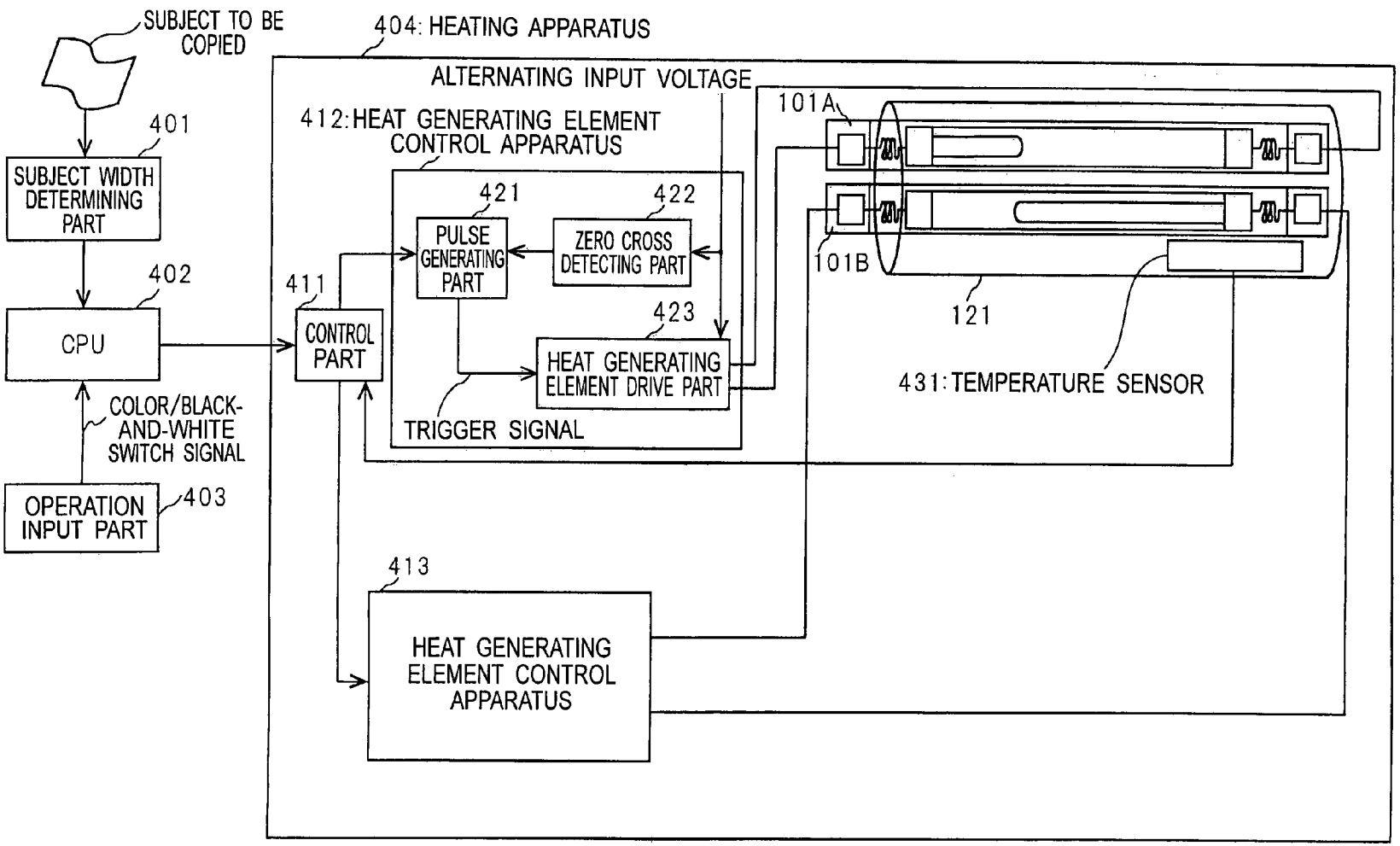
FIG. 4 is a block diagram showing a structure of an electronic apparatus in accordance with the embodiment 1 of the present invention.

FIG. 4 is a block diagram showing a structure of the copying machine (relating only to the heating apparatus) using the infrared ray lamp in accordance with the present invention. The copying machine has a subject width determining part 401, a CPU 402, an operation input part 403, and a heating apparatus 404. The heating apparatus 404 has a control part 411, heat generating element control apparatuses 412 and 413, and a heating roller 121. A temperature sensor 431 is attached to a surface of the heating roller 121. The heat generating element control apparatus 412 has a pulse generating part 421, a zero cross detecting part 422, and a heat generating element drive part 423. Since the heat generating element control apparatus 413 has the same structure as the heat generating element control apparatus 412, an illustration will be omitted.

A user puts the subject to be copied on the copying machine and inputs an instruction of selecting either a color copy or a black-and-white copy to the operation input part 403. The subject width determining part 401 detects the width of the subject to be copied so as to transmit to the CPU 402. The CPU 402 transmits the width of the subject to be copied and a color/black-and-white switch signal transmitted from the operation input part 403 to the control part 411 of the heating apparatus 404.

The control part 411 of the heating apparatus 404 inputs a signal from the CPU 402, and a surface temperature of the heating roller 121 detected by the temperature sensor 431. For example, the control part 411 controls so as to drive only the heat generating element control apparatus 413 if the width of the subject to be copied is the A4 landscape size (a first mode), and drive the heat generating element control apparatuses 412 and 413 if the width of the subject to be copied is the A3 size (a second mode). The heat generating element control apparatuses 412 and 413 control an applied power to the infrared ray lamps 101A and 101B based on a phase control. The applied power to the infrared ray lamp 101B in the second mode is controlled so as to be smaller than the applied power to the infrared ray lamp 101B in the first mode. Accordingly, as shown in FIG. 3C, an effective calorific power per a unit area becomes approximately uniform in the longitudinal direction and the relation K5=K2 is established.

Figure 5:
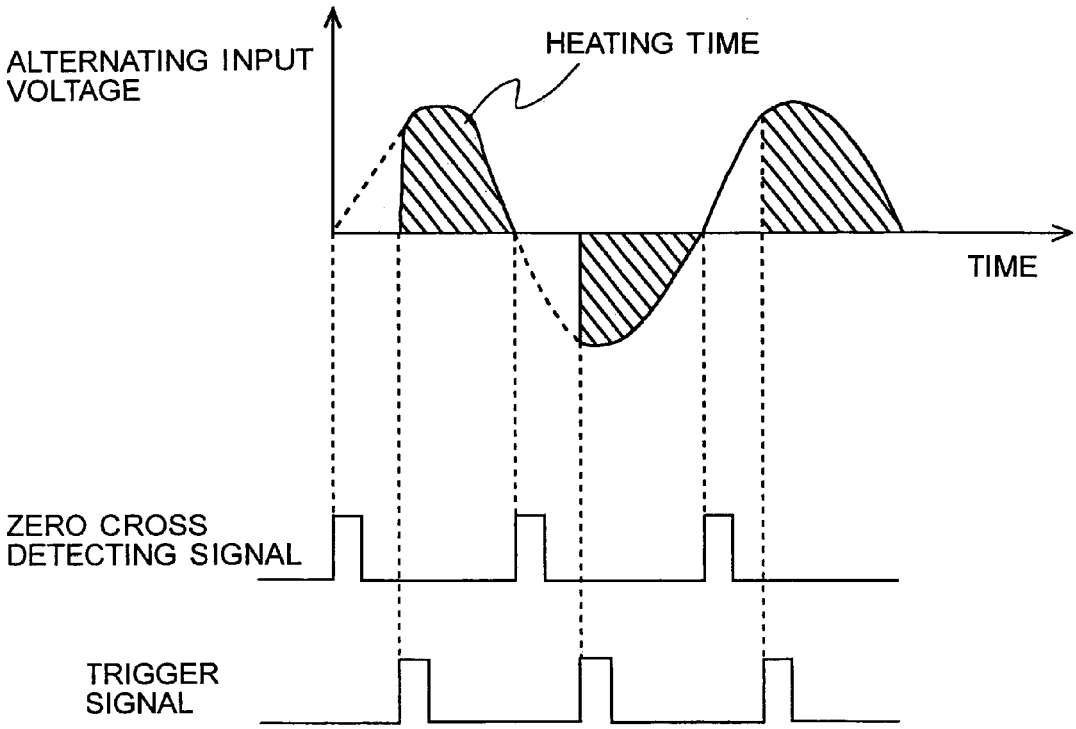
FIG. 5 is a view of a drive wave form of a heating apparatus in accordance with the embodiment 1 of the present invention.

FIG. 5 is a view showing the phase control of the heat generating element control apparatus. The heat generating element control apparatuses 412 and 413 input an alternating input voltage (100 V of 50 Hz or 60 Hz in the embodiment 1), and transmits it to the zero cross detecting part 422 and the heat generating element drive part 423. The zero cross detecting part 422 outputs a zero cross detecting signal of the alternating input voltage, and the pulse generating part 421 outputs a trigger signal having a rising edge in a predetermined phase in which a rising edge of the zero cross detecting signal is corresponding to a starting point based on the zero cross detecting signal and the signal from the control part 411. The control part 411 controls a phase of the trigger signal so that the temperature detected by the temperature sensor 431 becomes a predetermined target temperature. In the color mode, the control part 411 sets a target temperature to a higher temperature than the black-and-white mode. The heat generating element drive part 423 has a bidirectional thyristor. The thyristor inputs the trigger signal so as to be conductive, supplies an electric power to the heat generating element 101A and/or 101B, and is next returned to a cut-off state at the zero cross point of the alternating input voltage. In FIG. 5, the infrared ray lamp 101A and/or 101B is applied the electric power in a section shown by an oblique line.

Figure 6:
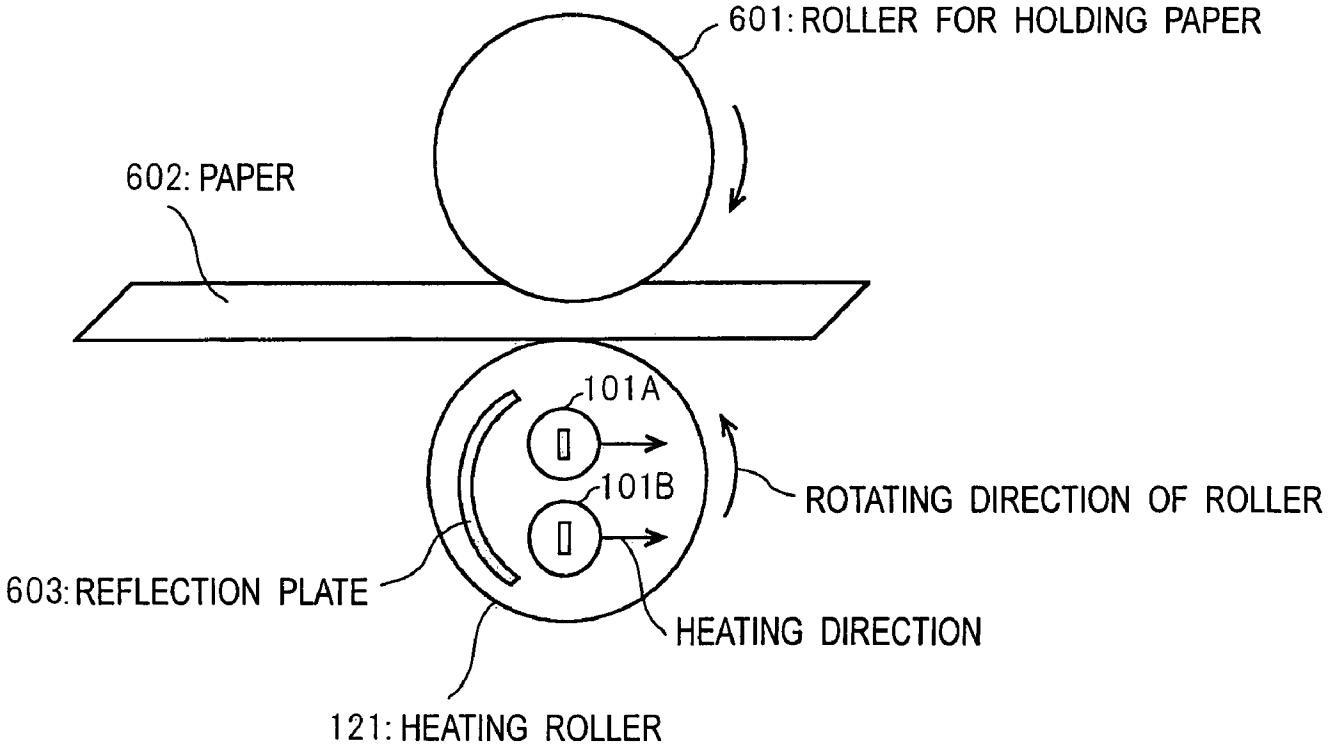
FIG. 6 is a schematic view of the electronic apparatus in accordance with the embodiment 1 of the present invention.

FIG. 6 is a view showing a heating direction of the infrared ray lamp and a position of a reflection plate. The heating roller 121 of the copying machine arranges the infrared ray lamps 101A and 101B in parallel, and has a reflection plate 603 in a rear side of the infrared ray lamp. The copying machine catches a paper 602 between a roller 601 for holding the paper and the heating roller 121, and fixes a paint (a toner) to the paper 602 by a heat of the heating roller 121. Since the heating direction of the infrared ray lamps 101A and 101B is set before a contact point between the heating roller 121 and the paper 602, the heating roller is sufficiently heated when fixing the paint (the toner). The heat generating elements 101A and 101B made of the carbon-based material reach a predetermined temperature just after being applied with the electric power and the temperature is high. Accordingly, the infrared ray lamp 101A and/or 101B can locally heat the part just before the contact point between the heating roller 121 and the paper 602 to the predetermined temperature. When the paper 602 on which the paint is fixed is ejected, the control part 411 immediately stops applying the electric power to the infrared ray lamps 101A and 101B.

Embodiment 2

Figure 8:
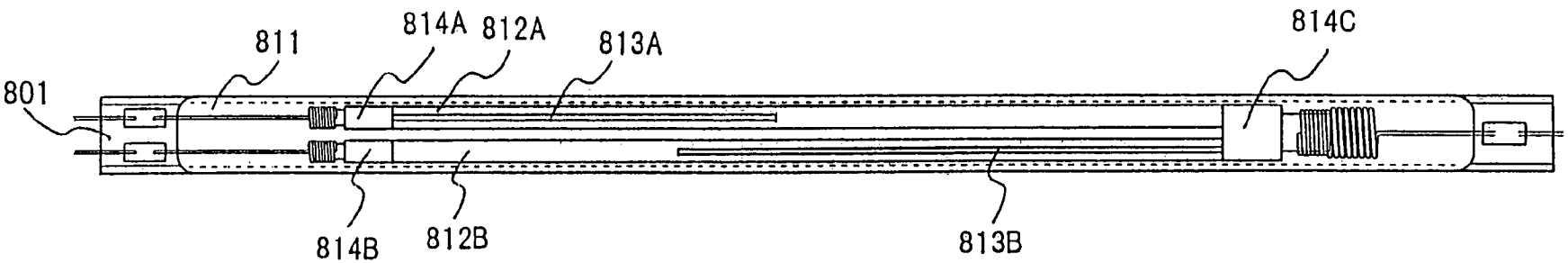
FIG. 8 is a view showing a structure of an infrared ray lamp in accordance with an embodiment 2 of the present invention.

A description will be given of an infrared ray lamp in accordance with an embodiment 2 with reference to FIG. 8. FIG. 8 is a view showing a structure of the infrared ray lamp in accordance with the embodiment 2. The infrared ray lamp 101 in accordance with the embodiment 1 seals one heat generating element 112A (or 112B) having an opening part 113A (or 113B) in one glass tube 111A (or 111B). An infrared ray lamp 801 in accordance with the embodiment 2 seals two heat generating elements 812A and 812B in one glass tube 811. The embodiment 2 is the same as the embodiment 1 in the other points.

The heat generating elements 812A and 812B are flat plate-shaped carbon-based heat generating elements formed by a sintered body including a carbon-based material. The heat generating elements 812A and 812B respectively have opening parts 813A and 813B positions which are different from each other in a longitudinal direction. One ends of the heat generating elements 812A and 812B are respectively held by holding blocks 814A and 814B, and the other ends are held by a holding block 814C. A glass tube 811 is a transparent silica glass tube, and an inert gas such as an argon gas or the like is sealed in the glass tube. An end part of the glass tube 811 is fused and crushed in a flat plate shape so as to seal.

A heating apparatus using the infrared ray lamp 801 in accordance with the embodiment 2 has the same effect as that of the heating apparatus using two infrared ray lamps 101A and 101B in accordance with the embodiment 1.

Since one glass tube seals two heat generating elements, the infrared ray lamp 801 is easily inserted to the heating roller, and the size of the heating roller can be small. A compact heating apparatus and electronic apparatus can be achieved by using the infrared ray lamp in accordance with the present invention.

Embodiment 3

Figure 9:
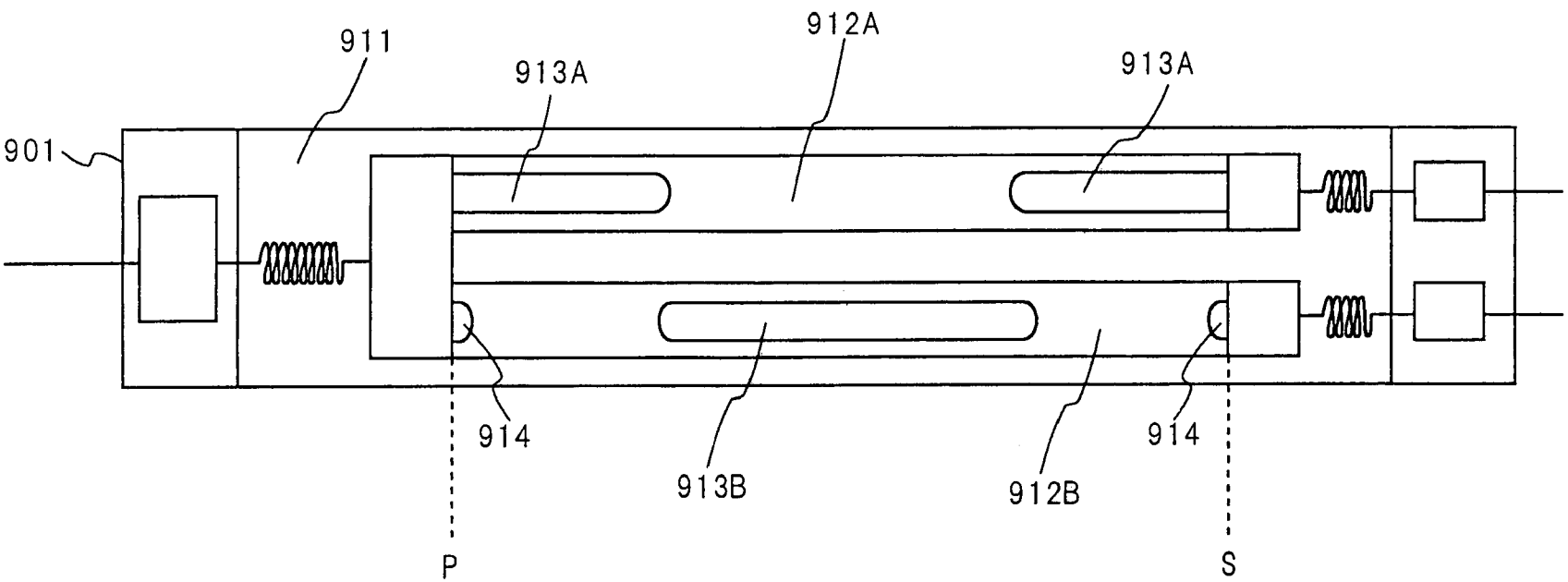
FIG. 9 is a view showing a structure of an infrared ray lamp in accordance with an embodiment 3 of the present invention.
Figure 10A:
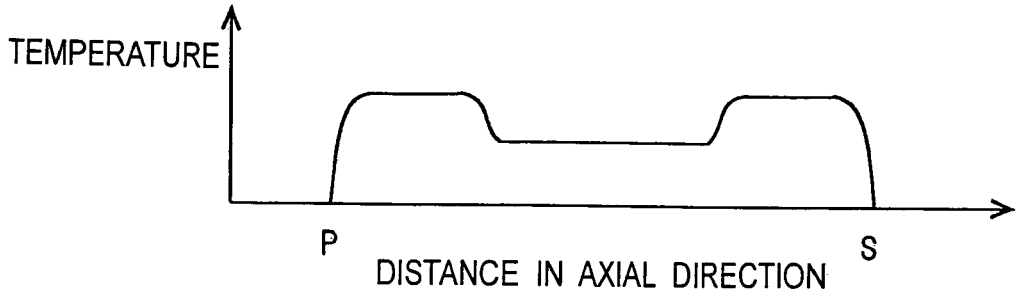
FIGS. 10A-C are temperature distribution views of the infrared ray lamp in accordance with the embodiment 3 of the present invention.

A description will be given of an infrared ray lamp in accordance with an embodiment 3 with reference to FIGS. 9 and 10. FIG. 9 is a view showing a structure of the infrared ray lamp in accordance with the embodiment 3. FIG. 10 is a view showing a temperature distribution with respect to an axial direction of the infrared ray lamp in accordance with the embodiment 3. In FIG. 10, a vertical axis shows a temperature, and a horizontal axis shows a distance in an axial direction of the infrared ray lamp.

An infrared ray lamp 901 in accordance with the embodiment 3 is different from the infrared ray lamp 801 in accordance with the embodiment 2 in the position of the opening part of the heat generating element. The embodiment 3 is the same as the embodiment 2 in the other points. The infrared ray lamps in accordance with the embodiments 1 and 2 are suitable for a copying machine or the like which puts a narrow paper (a subject to be copied) on an end of a table (a side of a set position of the wide paper and a side of a set position of the narrow paper are identical).

The infrared ray lamp 901 in accordance with the embodiment 3 is suitable for a copying machine, a printer or the like which puts the narrow paper (the subject to the copied) on a center of the table (a center line of the set position of the wide paper and a center line of the set position of the narrow paper are identical).

Figure 10B:
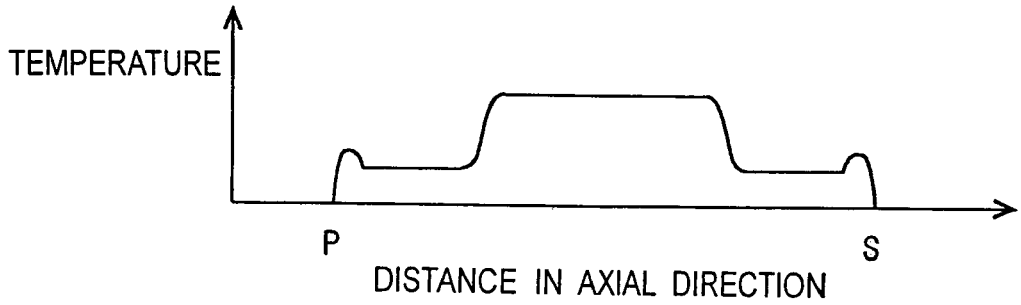
Figure 10C:
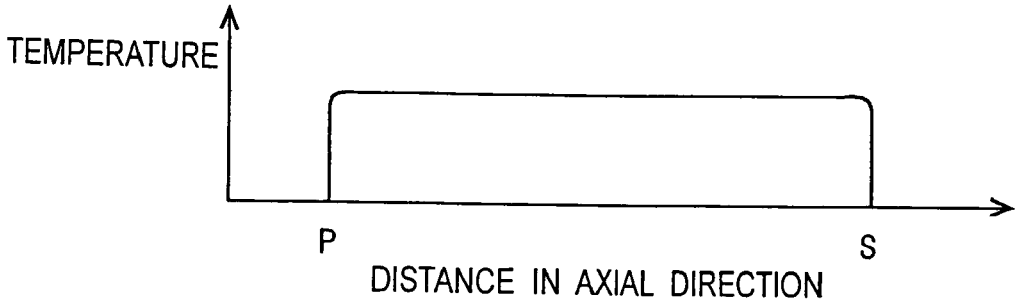

Heat generating elements 912A and 912B are flat plate-shaped carbon-based heat generating elements formed by a sintered body containing a carbon-based material. The heat generating element 912A in accordance with the embodiment 3 has opening parts 913A in both ends, and the heat generating element 912B has an opening part 913B in a center position. For example, in the case of using the landscape paper of A4 size, the electric power is supplied only to the heat generating element 912B (FIG. 10B). In the case of using the landscape paper of A3 size, the electric power is supplied to both of the heat generating element 912A and the heat generating element 912B (FIG. 10C). In the case of applying the electric power to both of the heat generating elements 912A and 912B, an effective calorific power per a unit area becomes approximately uniform in the longitudinal direction. Since the heat escapes to the holding block, a temperature of both ends of the heat generating element 912 tends to be low (for example, the temperature is low in both end parts in FIG. 10A). In the embodiment 3, a notch 914 is provided in both ends of the heat generating element 912B. Accordingly, in both ends of the heat generating element 912B, the calorific power becomes large because the cross sectional area is small (FIG. 10B). A dimension of the notch 914 is set such that even in the case of supplying the electric power to both of the heat generating elements 912A and 912B, the temperature is not low in both ends and the same heating temperature as the center part is achieved (FIG. 10C).

Embodiment 4

Figure 11:
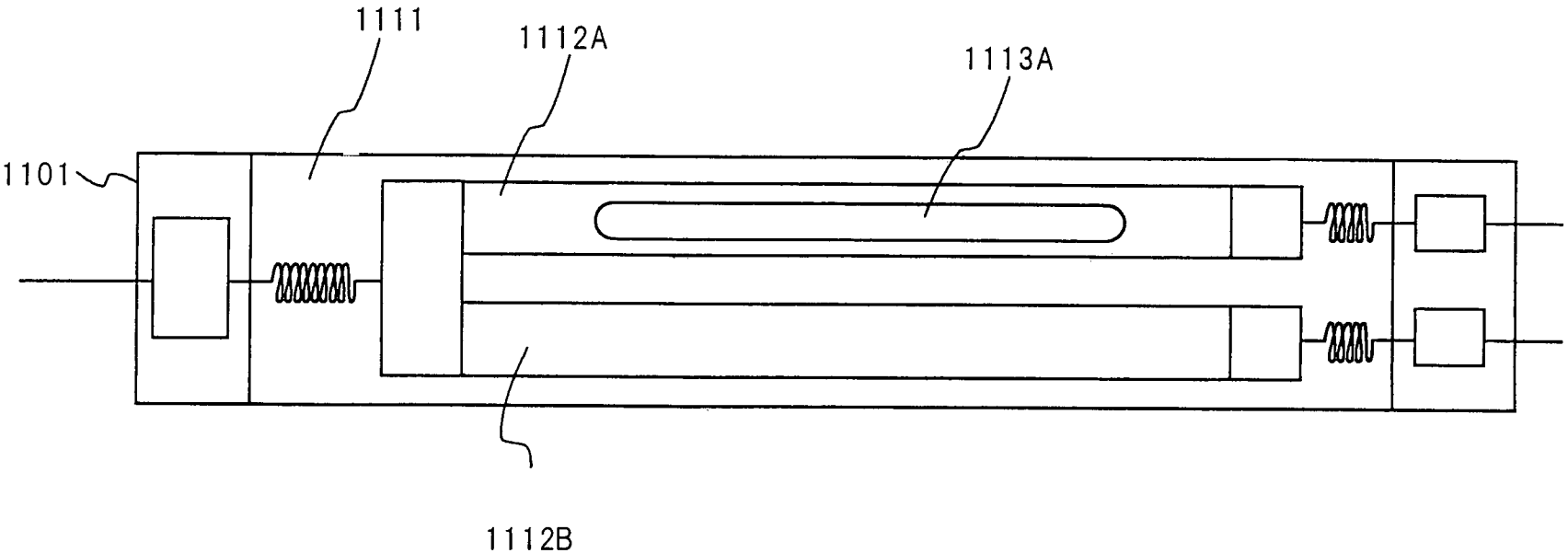
FIG. 11 is a view showing a structure of an infrared ray lamp in accordance with an embodiment 4 of the present invention.

A description will be given of an infrared ray lamp in accordance with an embodiment 4 with reference to FIG. 11. FIG. 11 is a view showing a structure of the infrared ray lamp in accordance with the embodiment 4. An infrared ray lamp 1101 in accordance with the embodiment 4 is different from the embodiment 3 in the position of the opening part of the heat generating element. The embodiment 4 is identical to the embodiment 3 in the other points, and has the same effect of setting the temperature distribution in the longitudinal direction of the infrared ray lamp to the desired one.

Heat generating elements 1112A and 1112B are flat plate-shaped carbon-based heat generating elements formed by a sintered body containing a carbon-based material. The heat generating element 1112A in accordance with the embodiment 3 has an opening part 1113A in a center position, and the heat generating element 1112B does not have any opening part. In the case of applying the electric power to the heat generating element 1112B, an effective calorific power per a unit area is approximately uniform in the longitudinal direction.

The infrared ray lamp 1101 is suitable for a printer which puts the paper in a center of the table. For example, in the case of using the landscape paper of A4 size, the electric power is supplied only to the heat generating element 1112A. In the case of using the landscape paper of A3 size, the electric power is supplied only to the heat generating element 1112B. At this time, the electric power applied to the heat generating element 1112A is equal to the electric power applied to the heat generating element 1112B. Further, in the case of using the landscape paper of A4 size, the electric power may be supplied only to the heat generating element 1112A in the black-and-white mode, and the electric power may be supplied to both of the heat generating elements 1112A and 1112B in the color mode.

Embodiment 5

Figure 12:
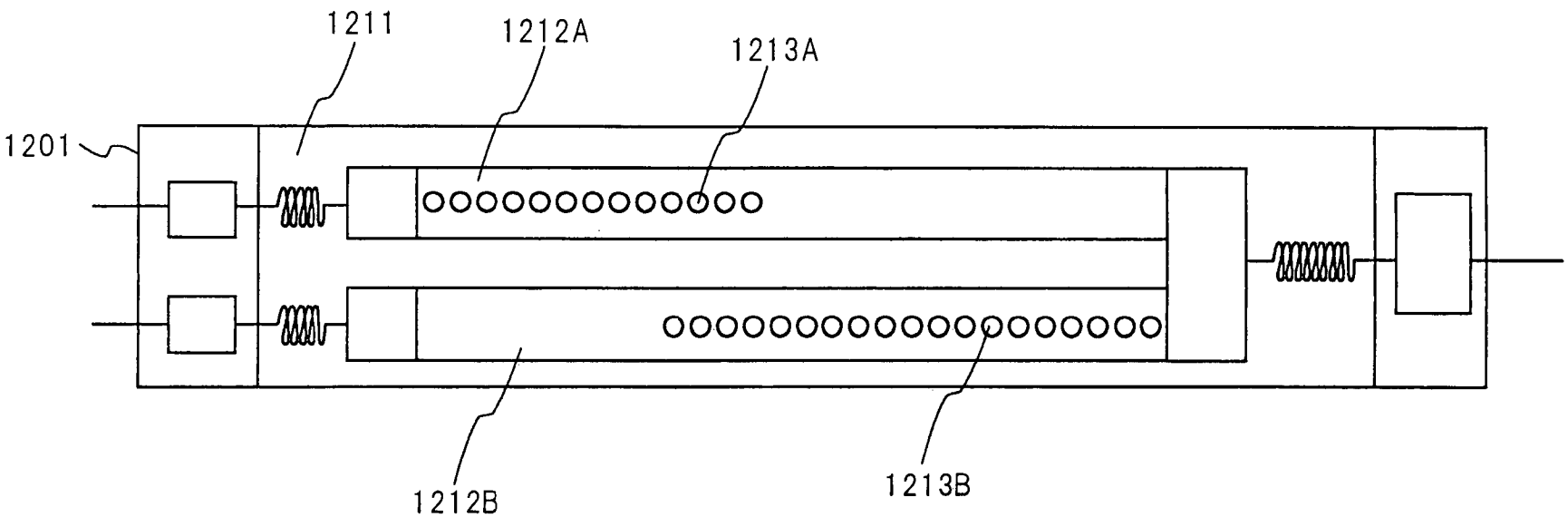
FIG. 12 is a view showing a structure of an infrared ray lamp in accordance with an embodiment 5 of the present invention.

A description will be given of an infrared ray lamp in accordance with an embodiment 5 with reference to FIG. 12. FIG. 12 is a view showing a structure of the infrared ray lamp in accordance with the embodiment 5. An infrared ray lamp 1201 in accordance with the embodiment 5 is different from the infrared ray lamp 801 the embodiment 2 in the shape of the opening part of the heat generating element. Heat generating elements 1212A and 1212B are flat plate-shaped carbon-based heat generating elements formed by a sintered body containing a carbon-based material. The heat generating element 1212 in accordance with the embodiment 5 has a plurality of small opening parts 1213 in a longitudinal direction. The embodiment 5 is identical to the embodiment 2 in the other points. In accordance with the structure mentioned above, the heat generating elements 1212A and 1212B have the opening parts extending substantially in the longitudinal direction, and the embodiment 5 has the same effects as those of the embodiment 2.

Embodiment 6

Figure 13A:
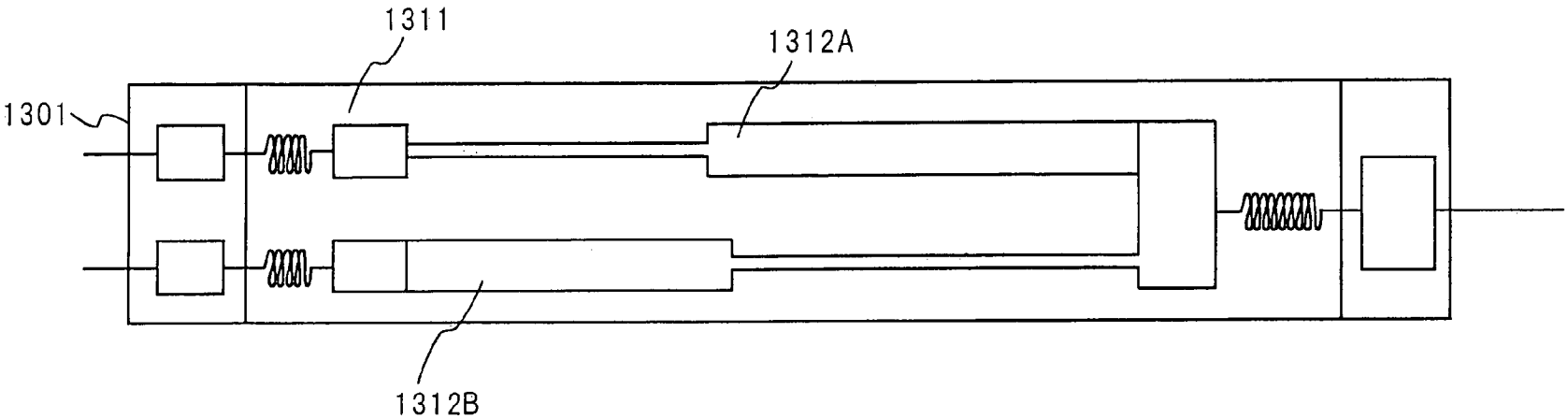
FIG. 13A-B are views showing a structure of an infrared ray lamp in accordance with an embodiment 6 of the present invention.
Figure 13B:
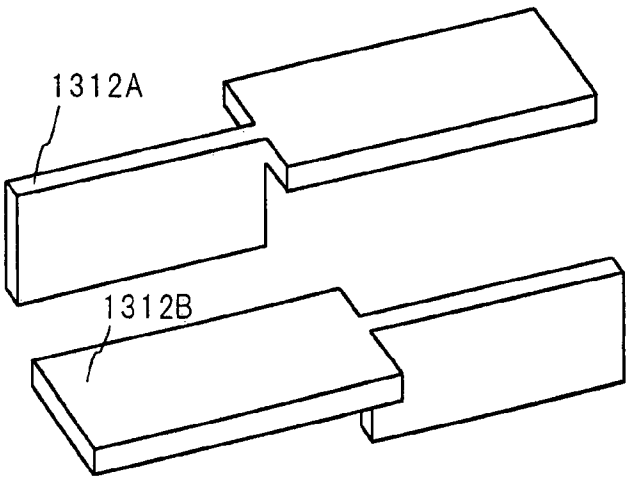

A description will be given of an infrared ray lamp in accordance with an embodiment 6 with reference to FIG. 13. FIG. 13A is a elevation showing a structure of the infrared ray lamp in accordance with the embodiment 6, and FIG. 13B is a perspective view of a heat generating element in accordance with the embodiment 6. An infrared ray lamp 1301 in accordance with the embodiment 6 is different from the embodiments 2 to 5 in a shape of the heat generating element. The embodiment 6 is identical to the embodiments 2 to 5 in the other points, and has the same effect of setting the temperature distribution in the longitudinal direction of the infrared ray lamp to the desired one.

Heat generating elements 1312A and 1312B are flat plate-shaped carbon-based heat generating elements formed by a sintered body containing a carbon-based material. The heat generating element 1312 in accordance with the embodiment 6 is cascaded so as to have a difference orientation in the longitudinal direction, and radiation strength of heat corresponding to a predetermined direction is changed. In FIG. 13, the orientation is different at 90 degree. The radiation width is different in accordance with the difference of the orientation of the heat generating elements 1312A and 1312B in correspondence to the position in the longitudinal direction, as seen from a predetermined direction. The position of the large radiation width of the heat generating elements 1312A and 1312B in the longitudinal direction is partly overlapped, and when both elements are simultaneously heated, the substantial calorific power per the unit area corresponding to the predetermined direction is approximately uniform in the longitudinal direction.

Since the temperature is low in both end parts of the heat generating elements 1312A and 1312B, the radiation width in both the end parts as seen from the predetermined direction is formed so as to be substantially wider than the radiation width in the other parts (not shown).

Furthermore, in the embodiments 3 to 6, instead of two heat generating elements sealed in one glass tube, two heat generating elements may be sealed in respective glass tubes.

Embodiment 7

Figure 14:
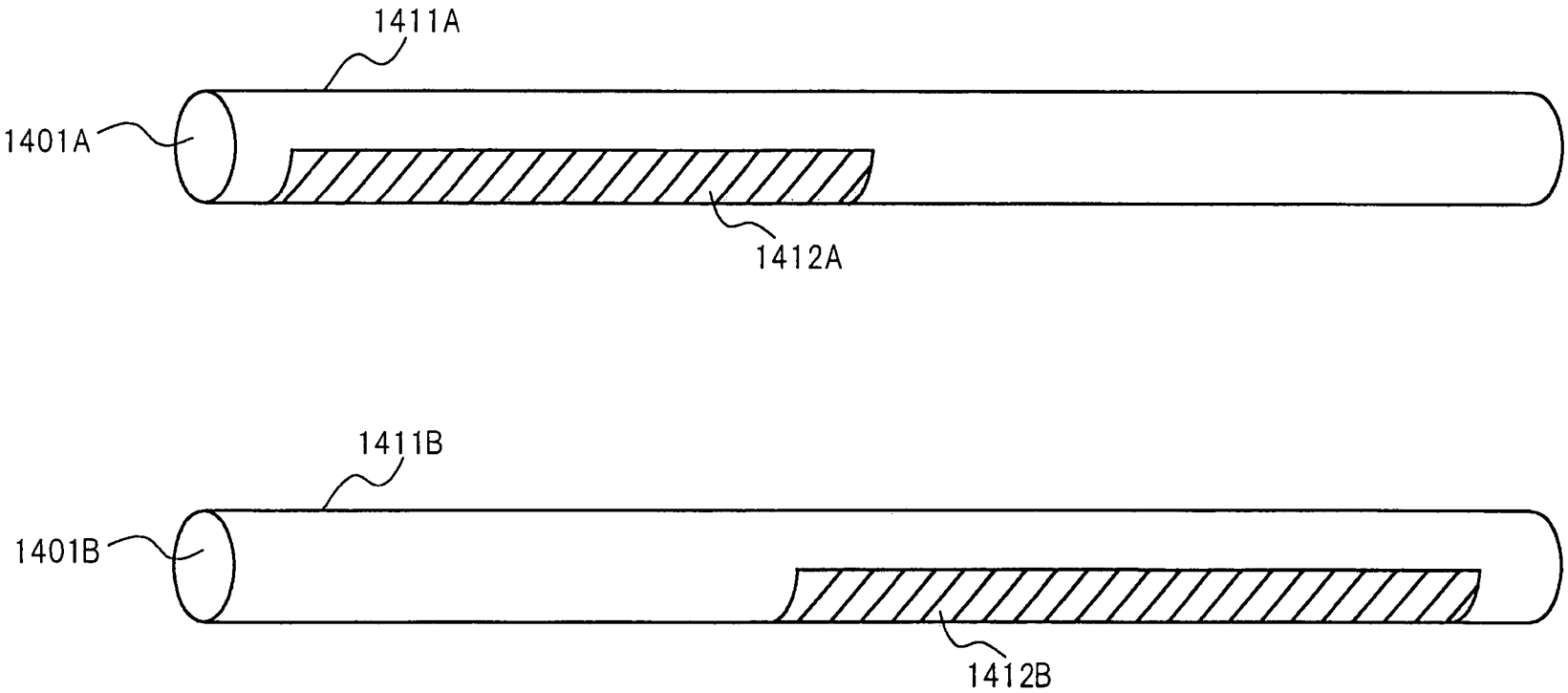
FIG. 14 is a view showing a structure of an infrared ray lamp in accordance with an embodiment 7 of the present invention.

A description will be given of an infrared ray lamp in accordance with an embodiment 7 with reference to FIG. 14. FIG. 14 is a view showing a structure of the infrared ray lamp in accordance with the embodiment 7. An infrared ray lamp 1401 in accordance with the embodiment 7 is different from the embodiment 1 with regard to change the radiation strength of the heat generating element corresponding to the predetermined direction (in which the subject to be heated is arranged) according to with or without a reflection film 1412. The embodiment 7 is identical to the embodiment 1 in the other points, and has the same effect of setting the temperature distribution in the longitudinal direction of the infrared ray lamp to the desired one.

A heating apparatus in accordance with the embodiment 7 has two infrared ray lamps 1401A and 1401B. The infrared ray lamps 1401A and 1401B respectively seal the flat plate-shaped carbon-based heat generating elements (not shown) having no opening part in glass tubes 1411A and 1411B. A material having a high emissivity is used as a reflection film 1412 and a reflection film 1412 is obtained by transferring a gold foil to an outer wall or an inner wall of the glass tube and thereafter sintering in the embodiment 7. Since the reflection film 1412 reflects about 70% of the infrared ray radiated from the heat generating element, the infrared ray is hardly radiated to the back side of the reflection film 1412.

In two infrared ray lamps 1401A and 1401B, the positions in the longitudinal direction of the reflection films 1412A and 1412B are different from each other, and the temperature distribution in the longitudinal direction of the infrared ray lamp is controlled by the part having the reflection film 1412 and the part having no reflection film 1412. Further, the reflection films 1412A and 1412B are structured such that the positions in one ends are overlapped with each other. In the first mode, the electric power is applied to the infrared ray lamp 1401A or 1401B, and the electric power is applied to both of the infrared ray lamps 1401A and 1401B in the second mode. In the second mode, a total of the substantial calorific power per the unit area of the infrared ray lamps 1401A and 1401B is approximately uniform in the longitudinal direction.

Furthermore, the infrared ray lamp in accordance with the embodiment 7 changes the radiation strength of the heat generating element between the part having the reflection film 1412 and the part having no reflection film 1412. In place thereto, it may be changed based on the (wide or narrow) width of the reflection film 1412.

Embodiment 8

Figure 15:
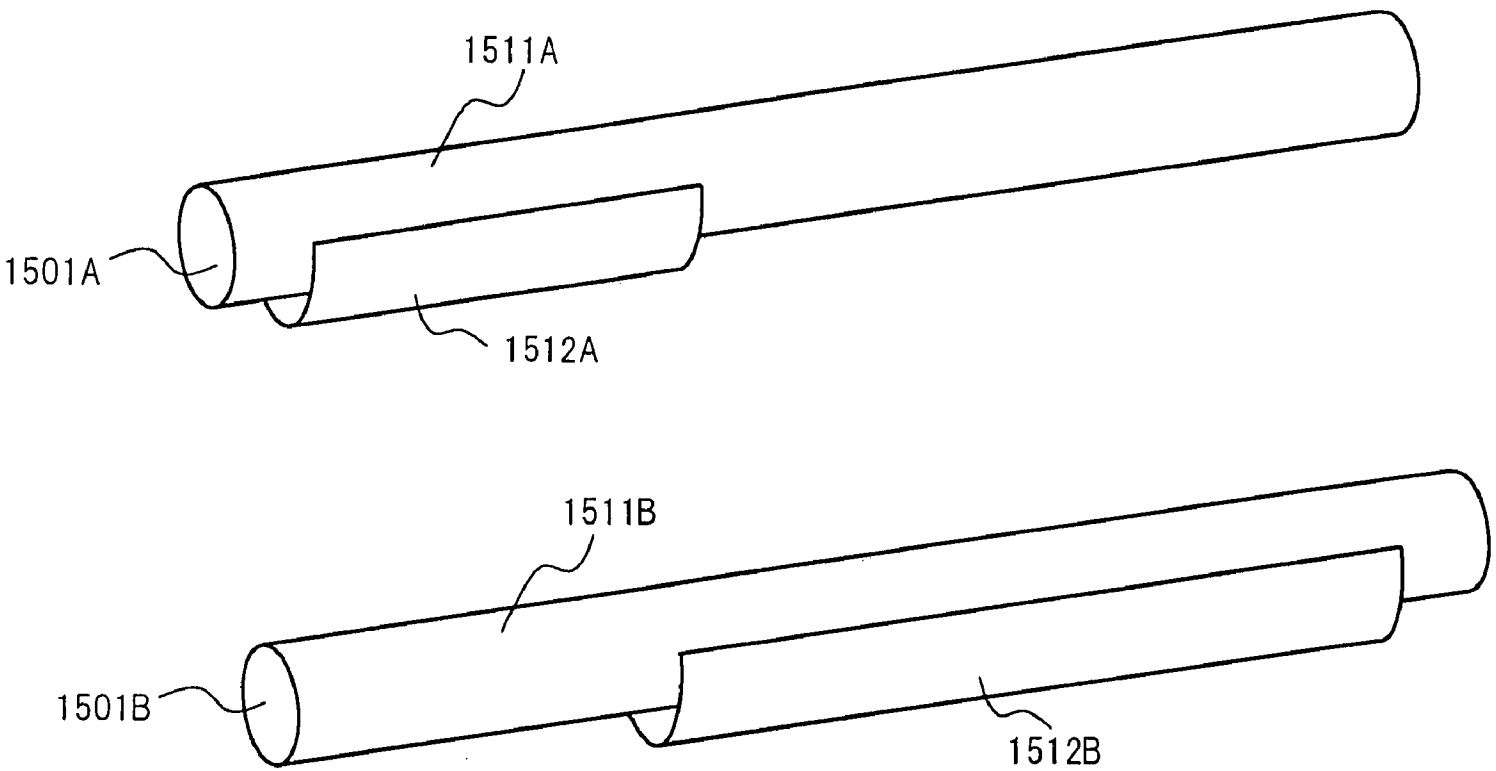
FIG. 15 is a view showing a structure of an infrared ray lamp in accordance with an embodiment 8 of the present invention.

A description will be given of an infrared ray lamp in accordance with an embodiment 8 with reference to FIG. 15. FIG. 15 is a view showing a structure of the infrared ray lamp in accordance with the embodiment 8. The infrared ray lamps 1401A and 1401B in accordance with the embodiment 7 have the reflection films. Infrared ray lamps 1501A and 1501B in accordance with the embodiment 8 change the radiation strength of the heat generating element corresponding to the predetermined direction (in which the subject to be heated is arranged) by using reflection plates 1512A and 1512B. The embodiment 8 is identical to the embodiment 7 in the other points, and has the same effects.

A heating apparatus in accordance with the embodiment 8 has two infrared ray lamps 1501A and 1501B. The infrared ray lamps 1501A and 1501B respectively seal flat plate-shaped carbon-based heat generating elements (not shown) having no opening parts in glass tubes 1511A and 1511B. The reflection plates 1512A and 1512B are closely attached to the glass tube 1511, or are provided at a predetermined distance. The reflection plates 1512A and 1512B are formed by a material having a high reflectance such as an aluminum, a SUS or the like.

In two infrared ray lamps 1501A and 1501B, positions in the longitudinal direction of the reflection plates 1512A and 1512B are different from each other, and the temperature distribution in the longitudinal direction of the infrared ray lamps is controlled by the part having the reflection plates 1512A and 1512B and the part having no reflection plates 1512A and 1512B. Further, since the reflection plates 1512A and 1512B are overlapped with each other in the position of one ends, the substantial calorific power per the unit area is approximately uniform in the longitudinal direction in the case of applying the electric power to both of the infrared ray lamps A and B.

Furthermore, in the embodiment 8, the radiation strength of the heat generating element is changed between the part having the reflection plate 1512 and the part having no reflection plate 1512. In place of this, it may be changed based on the (wide or narrow) width of the reflection plate 1512.

Embodiment 9

Figure 16A:
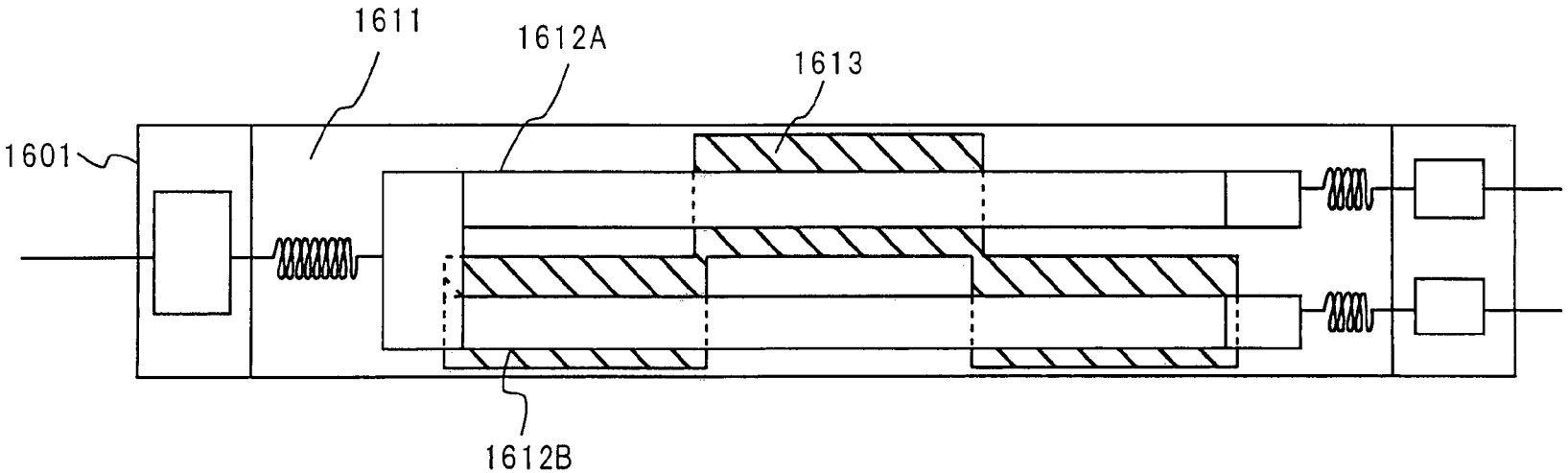
FIGS. 16A-B are views showing a structure of an infrared ray lamp in accordance with an embodiment 9 of the present invention.
Figure 16B:
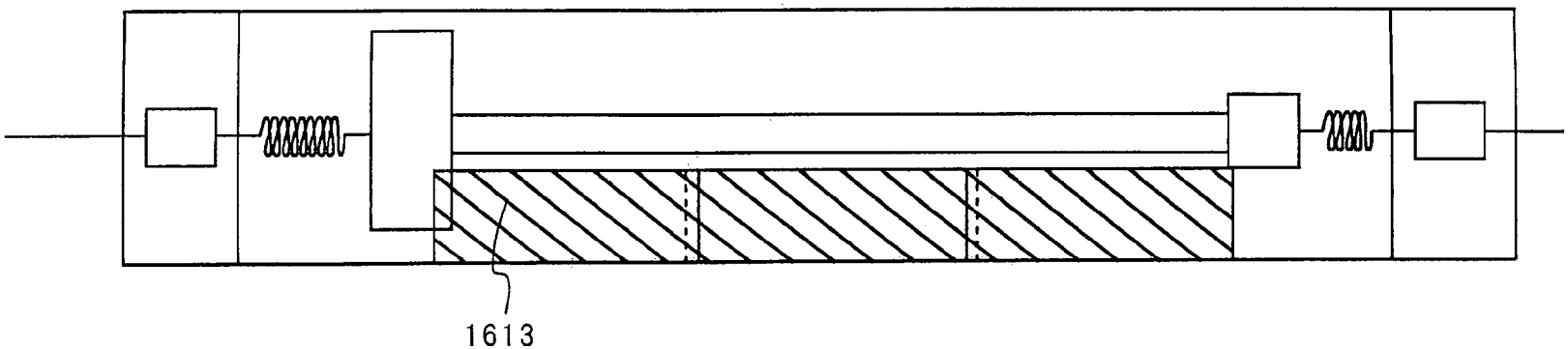
Figure 17:
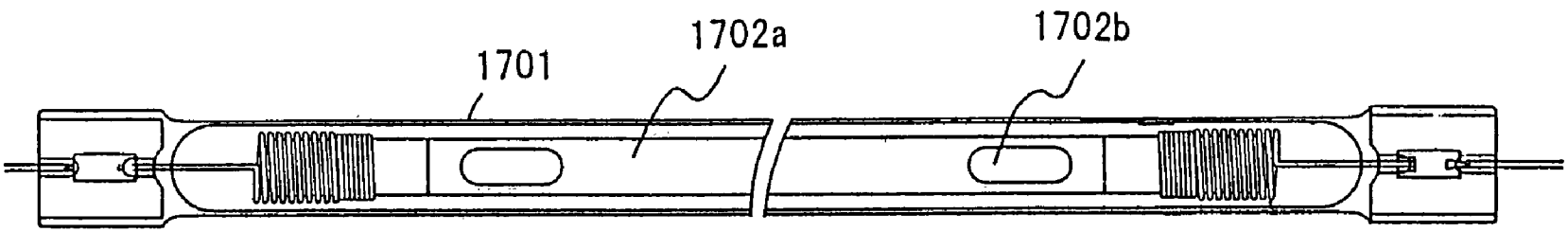
FIG. 17 is a view showing a structure of an infrared ray lamp in accordance with a prior art.

A description will be given of an infrared ray lamp in accordance with an embodiment 9 with reference to FIG. 16. FIG. 16A is a elevation showing a structure of the infrared ray lamp in accordance with the embodiment 9, and FIG. 16B is a plan view thereof. An infrared ray lamp 1601 in accordance with the embodiment 9 seals two heat generating elements 1612A and 1612B in one glass tube 1611, and has a reflection film 1613 in an outer wall of the glass tube 1611.

The heat generating elements 1612A and 1612B are flat plate-shaped carbon-based heat generating elements formed by a sintered body containing a carbon-based material and have no opening part. A material having a high emissivity is used as the reflection film 1613 and the reflection film 1613 is obtained by transferring a gold foil to an outer wall of the glass tube and thereafter sintering in the embodiment 9. The reflection film 1613 is differentiated in the shape in the longitudinal direction, and changes the radiation strength of the heat generating elements 1612A and 1612B.

In the other points, the embodiment 9 is identical to the embodiment 1, and has the same effect of setting the temperature distribution in the longitudinal direction of the infrared ray lamp to the desired one.

Furthermore, in place of the reflection film 1613, the reflection plate having a high reflection factor may be closely attached to the glass tube 1611 or may be provided at a predetermined distance.

Furthermore, although the infrared ray lamp in accordance with the embodiments 1 to 9 uses two heat generating elements, it is not limited to this. It is possible to achieve plural kinds of temperature distributions by using a plurality of heat generating elements.

In the embodiments 1 to 9, although the heating apparatus has the circuit shown in the embodiment 1, it is not limited to this.

In the embodiments 1 to 9, although the heating apparatus is installed in the copying apparatus, it is not limited to this. The heating apparatus in accordance with the present invention can be applied to an electronic apparatus of a copying machine, a facsimile machine, a printer, a printing machine, a fixing apparatus, an adhesion apparatus using a thermosetting adhesive agent, a ticket machine, an automatic ticket checking machine, a paper container manufacturing apparatus, a film heat fusion machine or the like. It is possible to install the heating apparatus in accordance with the present invention in the electronic apparatus, for example, based on the same structure as the embodiment 1.

In accordance with the present invention, it is possible to obtain an advantageous effect that it is possible to achieve a compact heating apparatus having a plurality of modes in which the heating widths are different, and an infrared ray lamp suitable for the heating apparatus.

In accordance with the present invention, it is possible to obtain an advantageous effect that a high reliable electronic apparatus can be achieved by having the above-mentioned heating apparatus.

In accordance with the present invention, it is possible to obtain an advantageous effect that it is possible to achieve a heating apparatus which has a high heating efficiency, can locally heat the part to be heated, reaches a rated temperature for an extremely short time after starting the heating, reduces a large rush current and flicker at a time of lighting, has a long service life, and can correspond to a plurality of modes having the different heating widths, and an infrared ray lamp suitable for the heating apparatus.

Although the present invention has been described with respect to its preferred embodiment in some detail, the disclosed contents of the preferred embodiment may change in the details of the structure thereof, and any changes in the combination and sequence of the component may be attained without departing from the scope and spirit of the claimed invention.

INDUSTRIAL APPLICABILITY

The infrared ray lamp in accordance with the present invention can be utilized in a heating apparatus. The heating apparatus in accordance with the present invention can be utilized, for example, in an electronic apparatus. The electronic apparatus in accordance with the present invention has an excellent heating function and is useful.

The invention claimed is:

1. An infrared ray lamp, comprising:

a plurality of heat generating elements arranged in parallel, the heat generating elements being formed by a sintered body including a carbon-based material and having a plate-shaped shape extending in a longitudinal direction at a fixed width and an opening part extending substantially in a longitudinal direction only provided in a part in the longitudinal direction;

a glass tube sealing said heat generating elements; and a plurality of connecting terminals being independently conductive with said respective heat generating elements, wherein in each of at least two said heat generating elements, said opening part is formed such that a cross sectional area in a part in a longitudinal direction of the heat generating element is smaller than a cross sectional area in the other parts of the heat generating element so that a resistance per unit length in the longitudinal direction of the heat generating element is increased, and the at least two heat generating elements are arranged such that the small cross sectional areas of the at least two heat generating elements are located at different longitudinal positions from each other.

2. The infrared ray lamp according to claim 1, wherein said opening part is formed by disk burnishing.

3. The infrared ray lamp according to claim 1, wherein the at least two said heat generating elements are arranged such that their end parts overlap each other in the longitudinal direction of the small cross sectional areas.

4. The infrared ray lamp according to claim 1, wherein a cross sectional area of both end parts of at least one of said heat generating elements is substantially smaller than a cross sectional area in the parts other than the end parts.

5. The infrared ray lamp according to claim 1, wherein in at least one of said heat generating elements, a calorific power per a unit area is approximately uniform in a longitudinal direction.

6. A heating apparatus comprising the infrared ray lamp according To claim 1.

7. A heating apparatus comprising the infrared ray lamp according to claim 3.

8. A heating apparatus, comprising:

a plurality of infrared ray lamps arranged in parallel, each of which comprise a heat generating element and a glass tube that seals said heat generating element, the heat generating element being formed by a sintered body including a carbon-based material and having a plate-shaped shape extending in a longitudinal direction at a fixed width and an opening part extending substantially in a longitudinal direction only provided in a part in the longitudinal direction, wherein said heat generating element includes at least a first heat generating element and a second heat generating element, wherein, in the first and second heat generating elements of at least two infrared ray lamps, said opening part is formed such that a cross sectional area in a part in the longitudinal direction of the first and second heat generating elements is substantially smaller than a cross sectional area in other parts, the first and second heat generating elements are arranged such that the small cross sectional areas of the first and second heat generating elements are located at different longitudinal positions from each other, and one end of each of the first and second heat generating elements overlap each other in the longitudinal directions of the small cross sectional areas, the first heat generating element and the second heat generating element are different in an effective calorific power per unit area in accordance with a position in a longitudinal direction, wherein only said first heat generating element generates heat in a first mode, both of said first heat generating element and said second heat generating element generate heat in a second mode, and an effective calorific power per unit area becomes approximately uniform in a longitudinal direction in said second mode.

9. The heating apparatus according to claim 8, wherein an applied power to said first heat generating element in said second mode is smaller than an applied power to said first heat generating element in said first mode.

10. The heating apparatus according to claim 9, wherein an applied power to said first heat generating element is controlled by a phase control based on an alternating input voltage in said first mode and said second mode.

11. The heating apparatus according to claim 9, comprising:

a temperature sensor detecting a temperature of a predetermined place, wherein an applied power to said first heat generating element and said second heat generating element is controlled by a phase control based on an alternating input voltage in accordance with said detected temperature.

12. An electronic apparatus comprising:

the heating apparatus according to claim 8, heats said heat generating element based on different combinations in accordance with a length or a position of a subject to be heated in a longitudinal direction of said heat generating element.

13. The electronic apparatus according to claim 12, wherein said electronic apparatus is a copying machine, a facsimile machine, a printer, a printing machine, a fixing apparatus, an adhesion apparatus using a thermosetting adhesive agent, a ticket machine, an automatic ticket checking machine, a paper container manufacturing apparatus or a film heat fusion machine.

14. The electronic apparatus according to claim 12, wherein said heating apparatus has a color mode of fixing a color paint and a black-and-white mode of fixing a black-and-white paint, and an electric power applied to said heat generating element in said color mode is larger than an electric power applied to the same said heat generating element in said black-and-white mode.

* * * * *